US008240639B2

(12) United States Patent
Roth

(10) Patent No.: US 8,240,639 B2
(45) Date of Patent: Aug. 14, 2012

(54) CARBURETOR AND AUTOMATIC CHOKE ASSEMBLY FOR AN ENGINE

(75) Inventor: David D. Roth, North Fond du Lac, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 677 days.

(21) Appl. No.: 12/242,853

(22) Filed: Sep. 30, 2008

(65) Prior Publication Data

US 2009/0146327 A1 Jun. 11, 2009

Related U.S. Application Data

(60) Provisional application No. 60/992,866, filed on Dec. 6, 2007.

(51) Int. Cl.
*F02M 1/08* (2006.01)

(52) U.S. Cl. ..... 261/52; 261/64.1; 261/64.6; 261/65

(58) Field of Classification Search ..... 261/52, 261/64.1, 64.6, 65
See application file for complete search history.

(56) References Cited

U.S. PATENT DOCUMENTS

| | | | | |
|---|---|---|---|---|
| 3,625,492 | A | 12/1971 | Reichenbach et al. | |
| 3,740,040 | A | 6/1973 | Brown, III et al. | |
| 3,886,917 | A | 6/1975 | Nakada et al. | |
| 3,965,224 | A * | 6/1976 | Freismuth | 261/39.3 |
| 4,113,808 | A | 9/1978 | Hackbarth et al. | |
| 4,132,751 | A | 1/1979 | Winkley | |
| 4,200,595 | A * | 4/1980 | Dye | 261/39.3 |
| 4,391,249 | A | 7/1983 | Bianchi et al. | |
| 4,961,409 | A * | 10/1990 | Kobayashi et al. | 123/376 |
| 5,069,180 | A | 12/1991 | Schmidt et al. | |
| 5,200,118 | A | 4/1993 | Hermle | |
| 5,500,159 | A | 3/1996 | Martinsson | |
| 5,611,312 | A | 3/1997 | Swanson et al. | |
| 6,000,683 | A | 12/1999 | Van Allen | |

(Continued)

FOREIGN PATENT DOCUMENTS

JP 54-22027 A * 2/1979

OTHER PUBLICATIONS

European Search Report for EP 08253803 dated Mar. 11, 2011.

*Primary Examiner* — Richard L Chiesa
(74) *Attorney, Agent, or Firm* — Rathe Lindenbaum LLP

(57) ABSTRACT

A carburetor configured for use with an internal combustion engine includes a body defining a passageway therein, a throttle lever including a cam surface, and a throttle valve positioned in the passageway and responsive to movement of the throttle lever. The throttle valve is configured to rotate about a first axis from a wide-open first position to a second position at least 50 degrees from the first position. The carburetor also includes a choke lever including a follower surface configured to be engaged by the cam surface and a choke valve positioned in the passageway and responsive to movement of the choke lever. One of the cam surface and the follower surface includes an arcuate segment having a constant radius centered on a second axis. The arcuate segment is sufficiently long such that the throttle valve is configured to move at least 15 degrees while the other of the cam surface and the follower surface engages the arcuate segment.

24 Claims, 30 Drawing Sheets

U.S. PATENT DOCUMENTS

| | | | | |
|---|---|---|---|---|
| 6,202,989 | B1 | 3/2001 | Pattullo | |
| 6,439,547 | B1 | 8/2002 | King et al. | |
| 6,454,245 | B2 * | 9/2002 | Kobayashi | 261/52 |
| 6,561,496 | B2 * | 5/2003 | Gliniecki et al. | 261/52 |
| 6,641,118 | B2 | 11/2003 | Schliemann | |
| 6,896,245 | B2 * | 5/2005 | Suzuki et al. | 261/23.2 |
| 6,990,969 | B2 * | 1/2006 | Roth et al. | 123/676 |
| 7,246,794 | B2 * | 7/2007 | Suzuki et al. | 261/52 |
| 7,377,496 | B2 * | 5/2008 | Toda et al. | 261/43 |
| 2001/0013664 | A1 * | 8/2001 | Kobayashi | 261/52 |
| 2002/0121710 | A1 | 9/2002 | King et al. | |
| 2003/0052422 | A1 | 3/2003 | Schliemann | |
| 2005/0116363 | A1 | 6/2005 | Koizumi | |
| 2006/0208371 | A1 * | 9/2006 | Suzuki et al. | 261/39.1 |

* cited by examiner

CARBURETOR AND AUTOMATIC CHOKE ASSEMBLY FOR AN ENGINE

CROSS-REFERENCE TO RELATED PATENT APPLICATIONS

The present application claims priority from U.S. Patent Application Ser. No. 60/992,866 filed on Dec. 6, 2007 by David Roth and entitled CARBURETOR AND AUTOMATIC CHOKE ASSEMBLY FOR AN ENGINE, the full disclosure of which is hereby incorporated by reference.

BACKGROUND

In small internal combustion engines utilizing a carburetor, such as those engines utilized in outdoor power equipment (e.g., a lawnmower, snowblower, etc.) cold temperature starting of the engine typically requires a more fuel-rich air-fuel mixture to sustain the combustion reaction. In some engines, this is done by closing a choke valve, thereby partially choking off the air supply to the cylinder or cylinders of the engine. As the engine warms up, the choke is no longer necessary because the increased temperatures in the engine help to sustain the combustion reaction and thus the choke is opened, allowing more air into the cylinder or cylinders for combustion.

Some carburetors utilized with small internal combustion engines include a throttle lever that engages, either directly or via an intermediate linkage, a choke lever coupled to the choke valve to actuate the choke valve. A governor is typically utilized to actuate the throttle lever and a throttle valve coupled to the throttle lever to control the speed of the engine.

SUMMARY OF THE INVENTION

The present invention provides, in one aspect, a carburetor configured for use with an internal combustion engine and includes a body defining a passageway therein, a throttle lever including a cam surface, and a throttle valve positioned in the passageway and responsive to movement of the throttle lever. The throttle valve is configured to rotate about a first axis from a wide-open first position to a second position at least 50 degrees from the first position. The carburetor also includes a choke lever including a follower surface configured to be engaged by the cam surface and a choke valve positioned in the passageway and responsive to movement of the choke lever. One of the cam surface and the follower surface includes an arcuate segment having a constant radius centered on a second axis. The arcuate segment is sufficiently long such that the throttle valve is configured to move at least 15 degrees while the other of the cam surface and the follower surface engages the arcuate segment.

The present invention provides, in one aspect, a carburetor configured for use with an internal combustion engine. The carburetor includes a body defining a passageway therein, a throttle lever including a cam surface, and a throttle valve positioned in the passageway and responsive to movement of the throttle lever. The throttle valve is configured to rotate about a first axis from a wide-open first position to a second position at least 50 degrees from the first position. The carburetor also includes a choke lever including a follower surface configured to be engaged by the cam surface, and a choke valve positioned in the passageway and responsive to movement of the choke lever. The cam surface includes an arcuate segment of a cylindrical surface, or an arcuate segment, having a constant radius centered on a second axis. The arcuate segment is sufficiently long such that the throttle valve is configured to move at least 15 degrees while the follower surface engages the arcuate segment of the cam surface.

The carburetor of the present invention is intended to be utilized with outdoor power equipment designed to operate under variable speeds and variable loads. By providing the arcuate segment on the cam surface of the carburetor of the present invention, reaction torque imparted on the throttle lever by the choke lever can be substantially reduced, or substantially eliminated over a wide range of throttle valve positions and engine speeds, thereby substantially preventing override of the governor's control of the throttle lever over a wide range of throttle valve positions and engine speeds. However, the carburetor of the present invention may also be utilized with other engine-powered equipment designed to operate at a substantially steady speed and load (e.g., a generator).

Other features and aspects of the invention will become apparent by consideration of the following detailed description and accompanying drawings.

Figure 1:
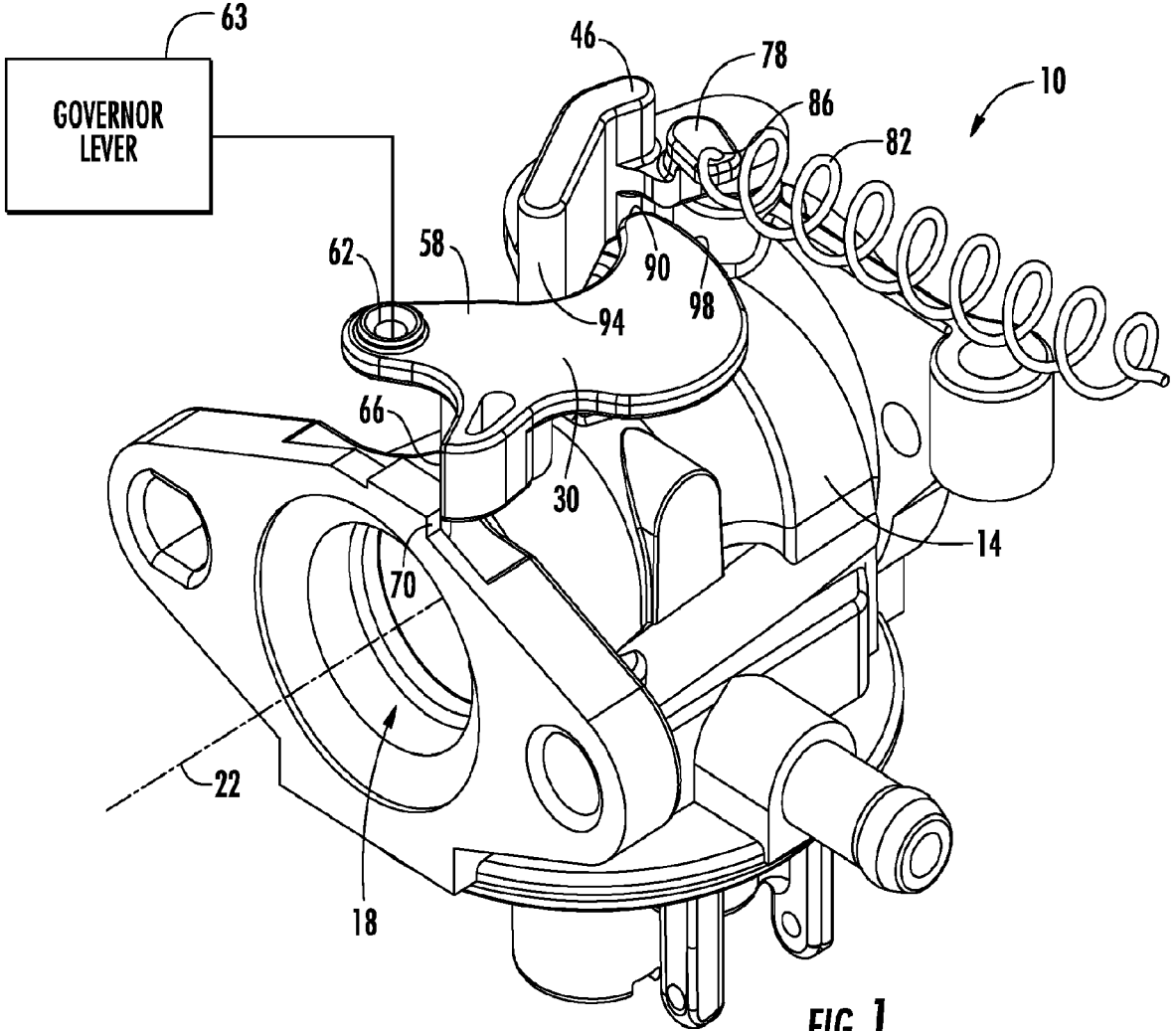
FIG. 1 is a top perspective view of a first construction of a carburetor of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION OF THE EXAMPLE EMBODIMENTS

FIGS. 1-4 illustrate a first construction of a carburetor 10 configured for use with a small engine. Such an engine may be utilized in outdoor power equipment (e.g., a lawnmower, snowblower, etc.) or other types of engine-powered equipment (e.g., a generator). The carburetor 10 includes a body 14 defining an air/fuel passageway 18 along a central axis 22. The carburetor 10 also includes a throttle valve 26 positioned in the passageway 18 and a throttle lever 30 coupled to the throttle valve 26 via a throttle shaft 34. The throttle valve 26, throttle shaft 34, and throttle lever 30 are pivotable about an axis 38 oriented substantially normal to the central axis 22 of the passageway 18. With continued reference to FIGS. 1-4, the carburetor 10 also includes a choke valve 42 positioned in the passageway 18 and a choke lever 46 coupled to the choke valve 42 via a choke shaft 50. The choke valve 42, choke shaft 50, and choke lever 46 are also pivotable about an axis 54 oriented substantially normal to the central axis 22 of the passageway 18.

Figure 2:
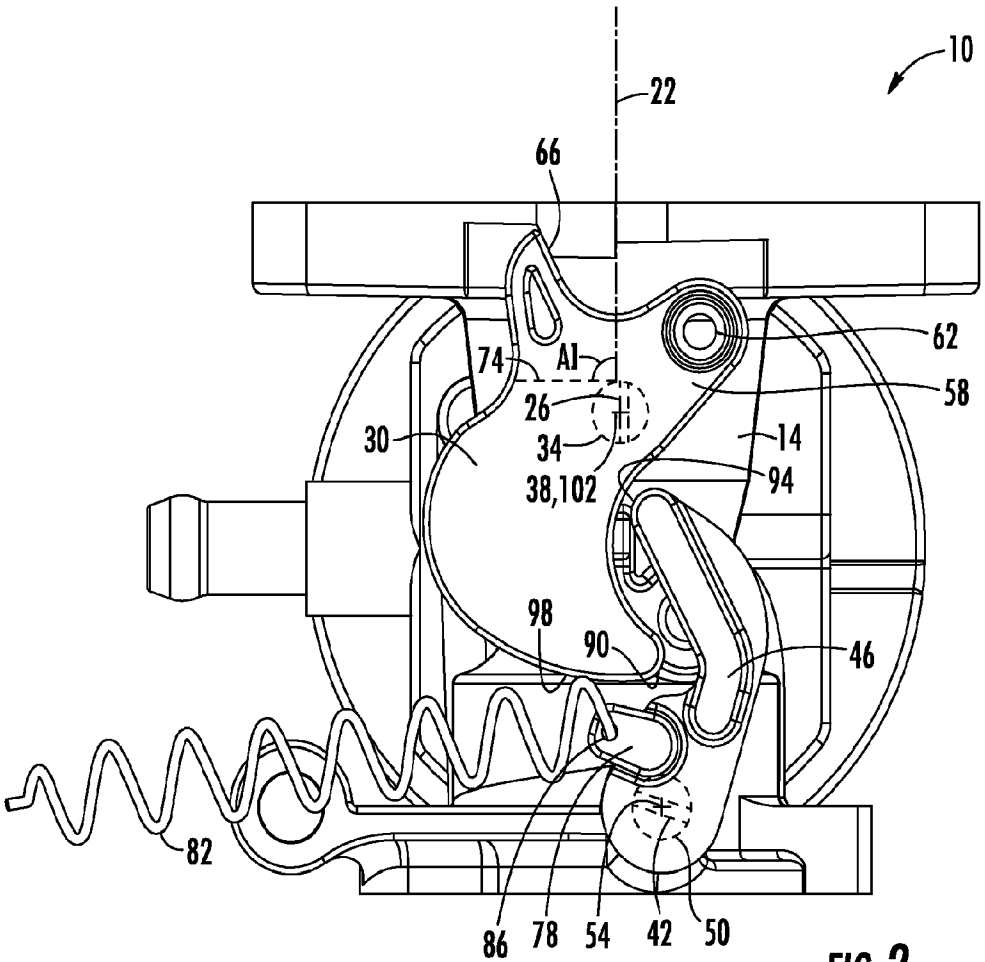
FIG. 2 is a top view of the carburetor of FIG. 1, illustrating a throttle lever in a first position corresponding with a fully-opened position of a throttle valve.
Figure 3:
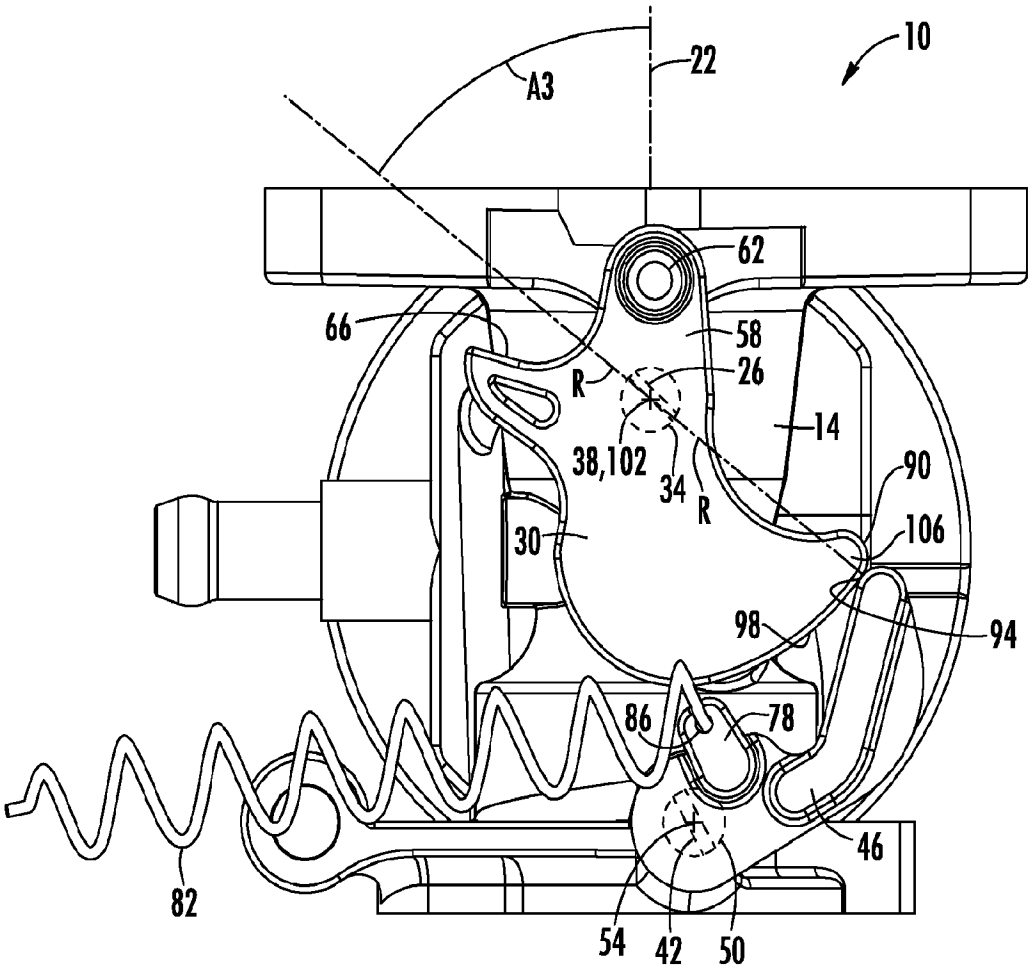
FIG. 3 is a top view of the carburetor of FIG. 1, illustrating the throttle lever in a second position corresponding with a first partially-closed position of the throttle valve.
Figure 4:
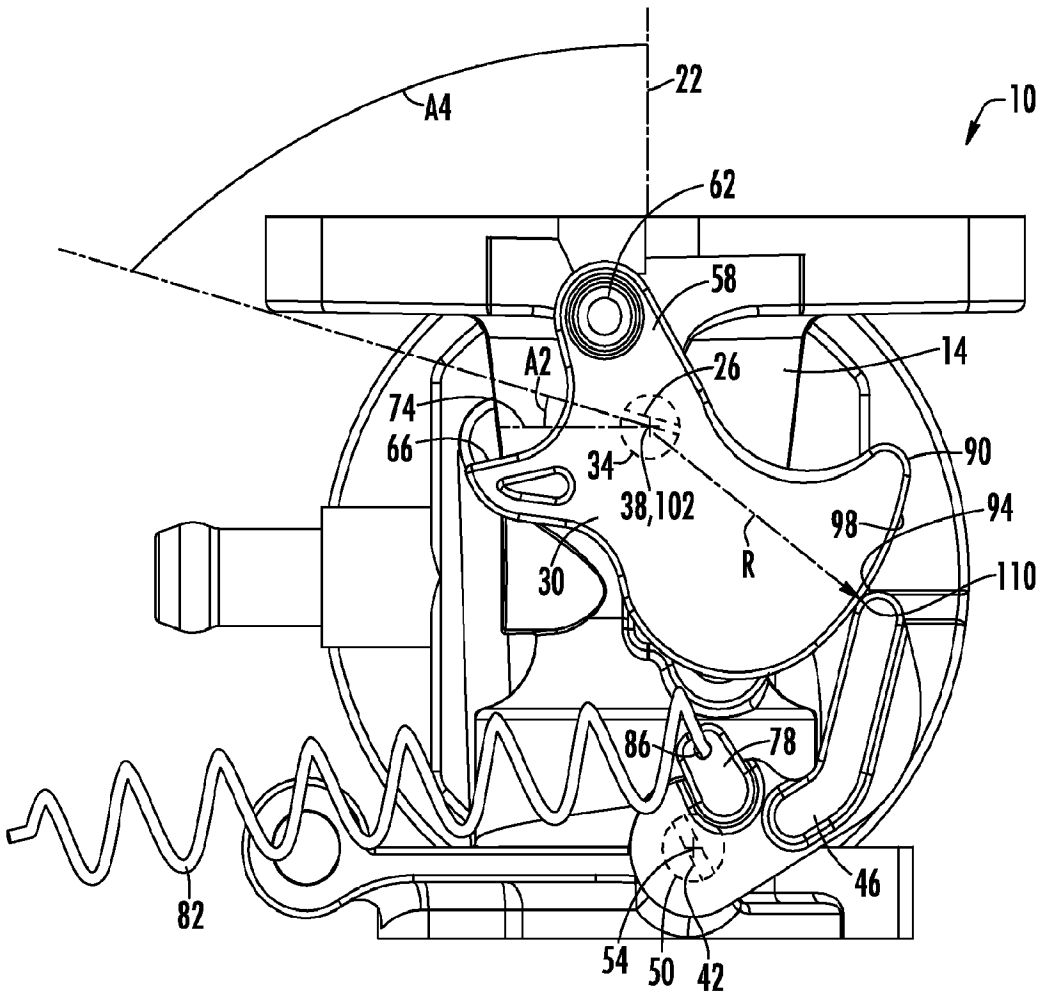
FIG. 4 is a top view of the carburetor of FIG. 1, illustrating the throttle lever in a third position corresponding with a second partially-closed position of the throttle valve.

With reference to FIGS. 2-4, the throttle lever 30 includes an arm 58 coupled to a governor lever 63 (shown in FIG. 1) of the engine, which, in turn, is selectively actuated by another component of a governor in the engine to open and close the throttle valve 26. In the illustrated construction of the throttle lever 30, the arm 58 includes an aperture 62 to facilitate coupling of the governor lever to the throttle lever 30 (e.g., by a fastener). Alternatively, the arm 58 may be coupled to the governor lever in any of a number of different ways.

With reference to FIG. 1, the throttle lever 30 also includes a stop 66 configured to engage different portions of the body 14 to limit the extent to which the throttle valve 26 may be opened and closed. In one construction of the carburetor 10, the stop 66 may engage a protrusion 70 on the carburetor 10 to limit the opening of the throttle valve 26. The stop 66 may also engage a screw threaded to a portion of the body 10 to limit the closing of the throttle valve 26. The protrusion 70 may be sized and positioned to limit the opening of the throttle valve 26 to a throttle angle A1 of about 90 degrees measured from a plane 74 normal to the central axis 22 of the passageway 18 (see FIG. 2). In other words, the protrusion 70 may be sized and positioned to limit the opening of the throttle valve 26 to an orientation in which the throttle valve 26 is substantially parallel to the central axis 22. In this position, the throttle valve 26 is "wide open" or fully opened to allow the maximum amount of airflow through the passageway 18. The screw may be adjusted relative to the body 14, for example, to limit the closing of the throttle valve 26 to a throttle angle A2 of about 15 degrees measured from the plane 74 (i.e., about 75 degrees "closed," from the fully-opened position of the throttle valve 26 shown in FIG. 2; see FIG. 4). Alternative constructions of the carburetor 10 may utilize any of a number of different structures and components to limit the opening and closing of the throttle valve 26.

With reference to FIGS. 1-4, the choke lever 46 includes an arm 78 coupled to a biasing member (e.g., a spring 82). The arm 78 includes an aperture 86 through which a portion of the spring 82 is inserted to couple the spring 82 to the arm 78. The arm 78 is positioned on the choke lever 46 such that the spring 82 applies a torque on the choke lever 46 about its axis 54 in a counter-clockwise direction, as shown in FIGS. 2-4, to bias the choke valve 42 toward a closed position. The choke lever 46 may include another arm (not shown) coupled to a thermally conductive assembly selectively operable to hold or maintain the choke lever 46 in a position in which the choke valve 42 is fully opened. Such a thermally conductive assembly is disclosed in U.S. Pat. No. 6,990,969, the entire content of which is incorporated herein by reference.

Figure 5:
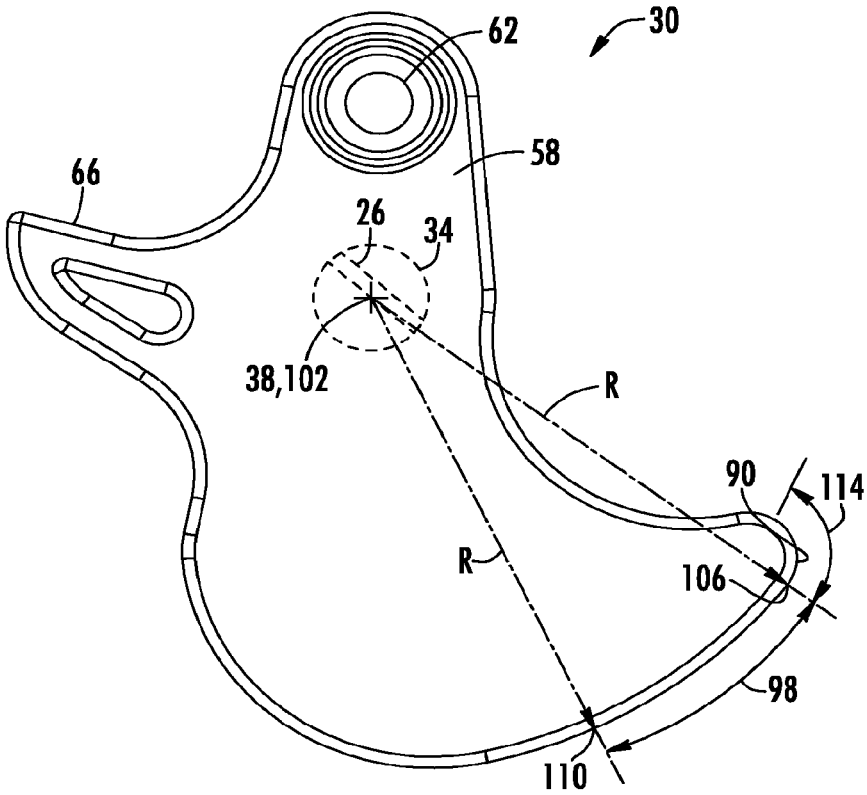
FIG. 5 is a top view of the throttle lever of the carburetor of FIG. 1.
Figure 6:
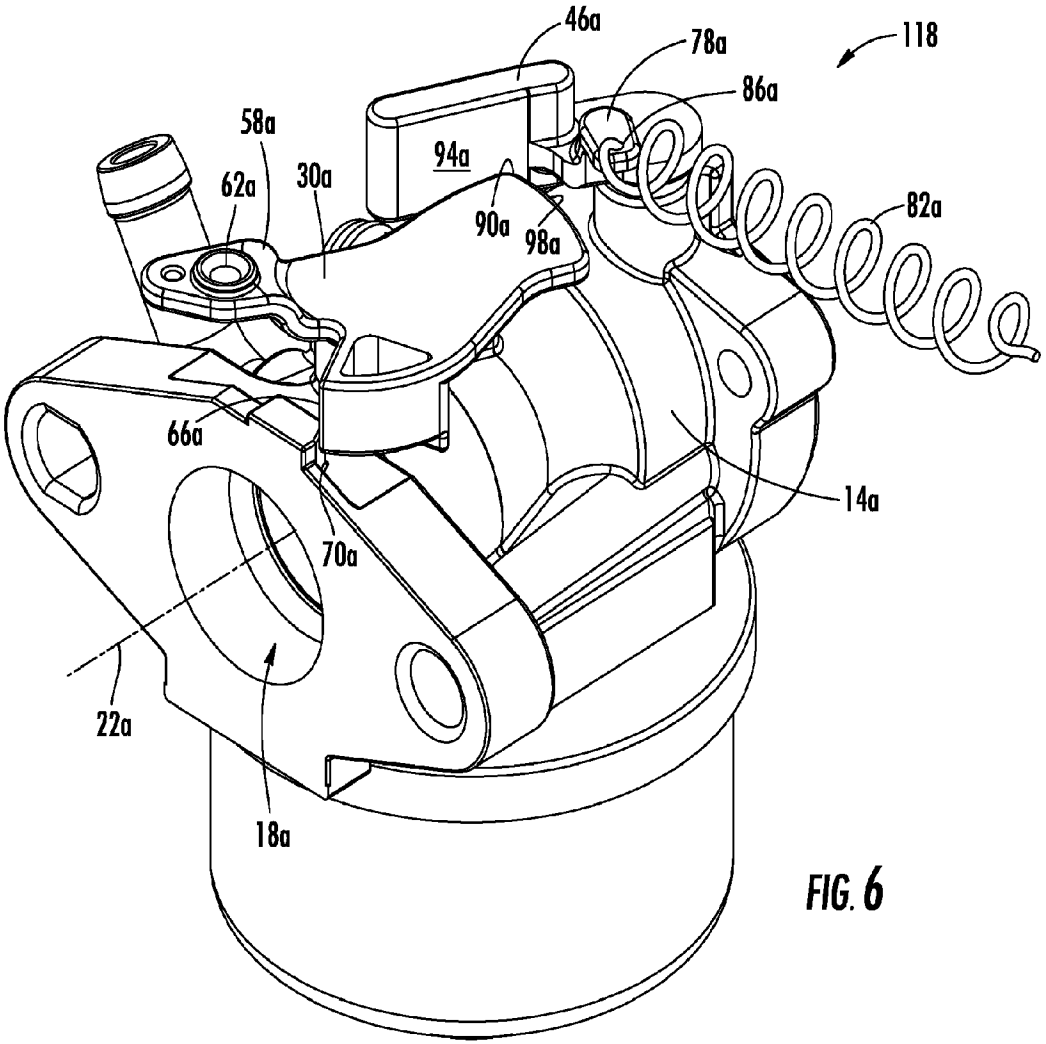
FIG. 6 is a top perspective view of a second construction of a carburetor of the present invention.
Figure 7:
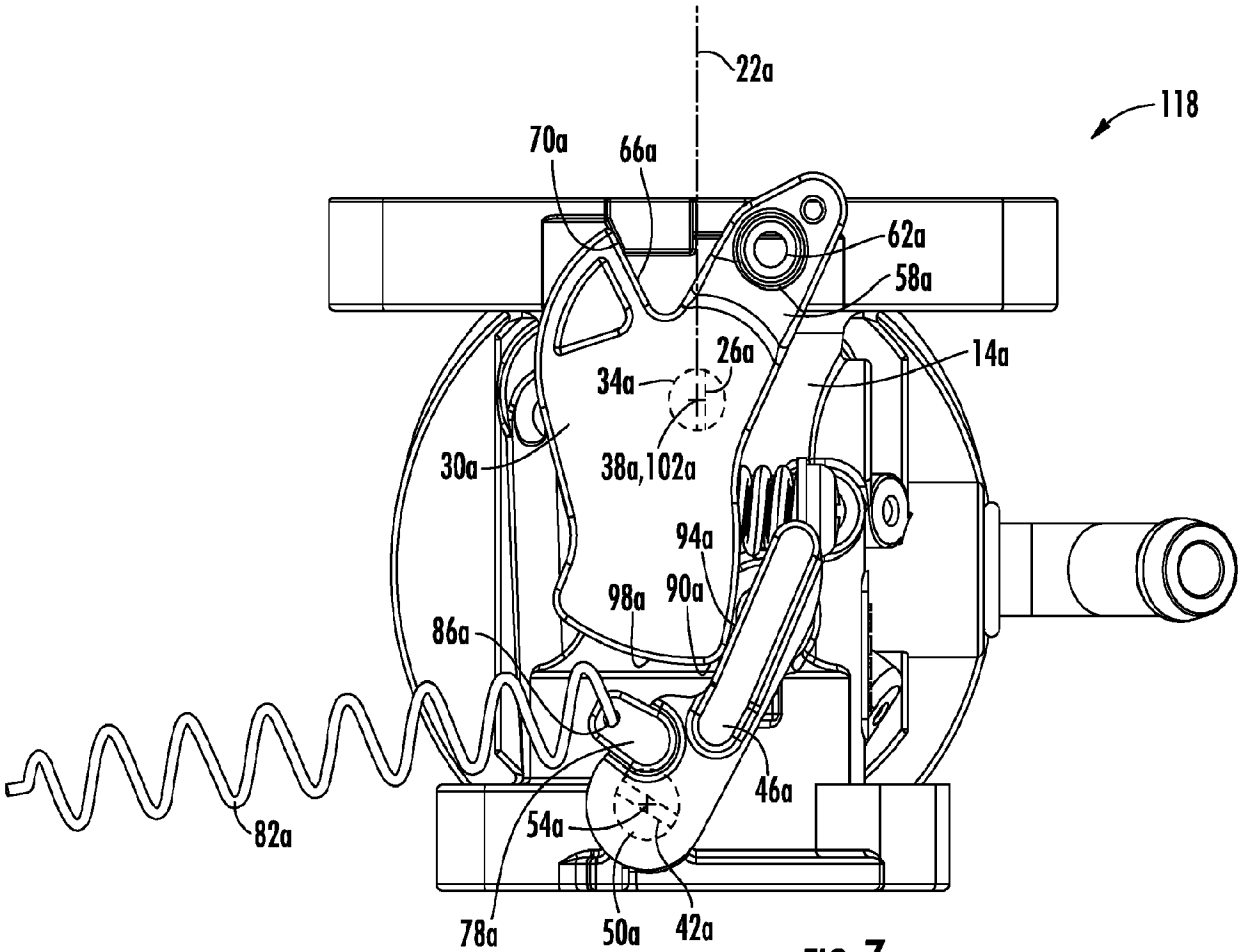
FIG. 7 is a top view of the carburetor of FIG. 6, illustrating a throttle lever in a first position corresponding with a fully-opened position of a throttle valve.
Figure 8:
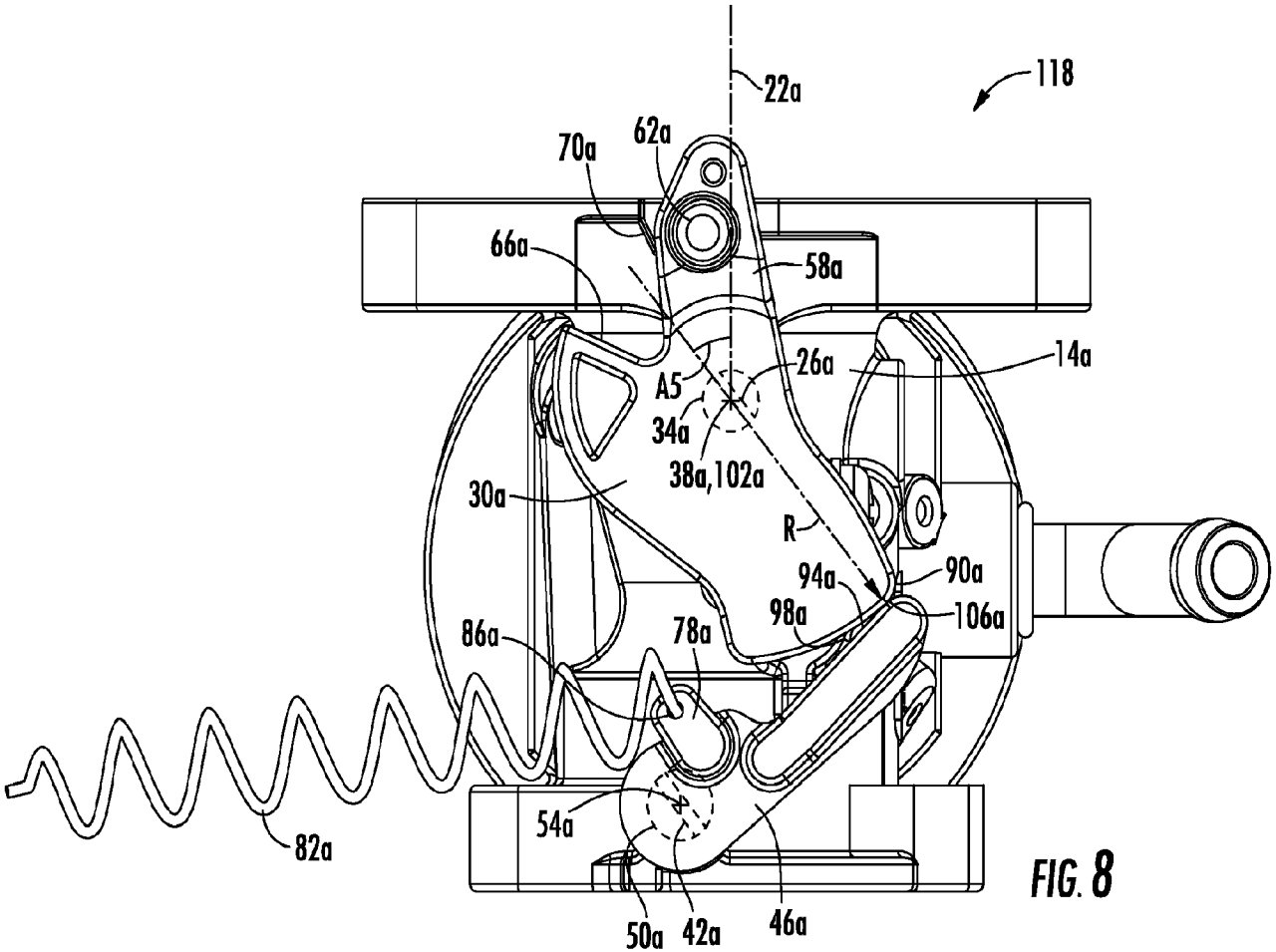
FIG. 8 is a top view of the carburetor of FIG. 6, illustrating the throttle lever in a second position corresponding with a first partially-closed position of the throttle valve.
Figure 9:
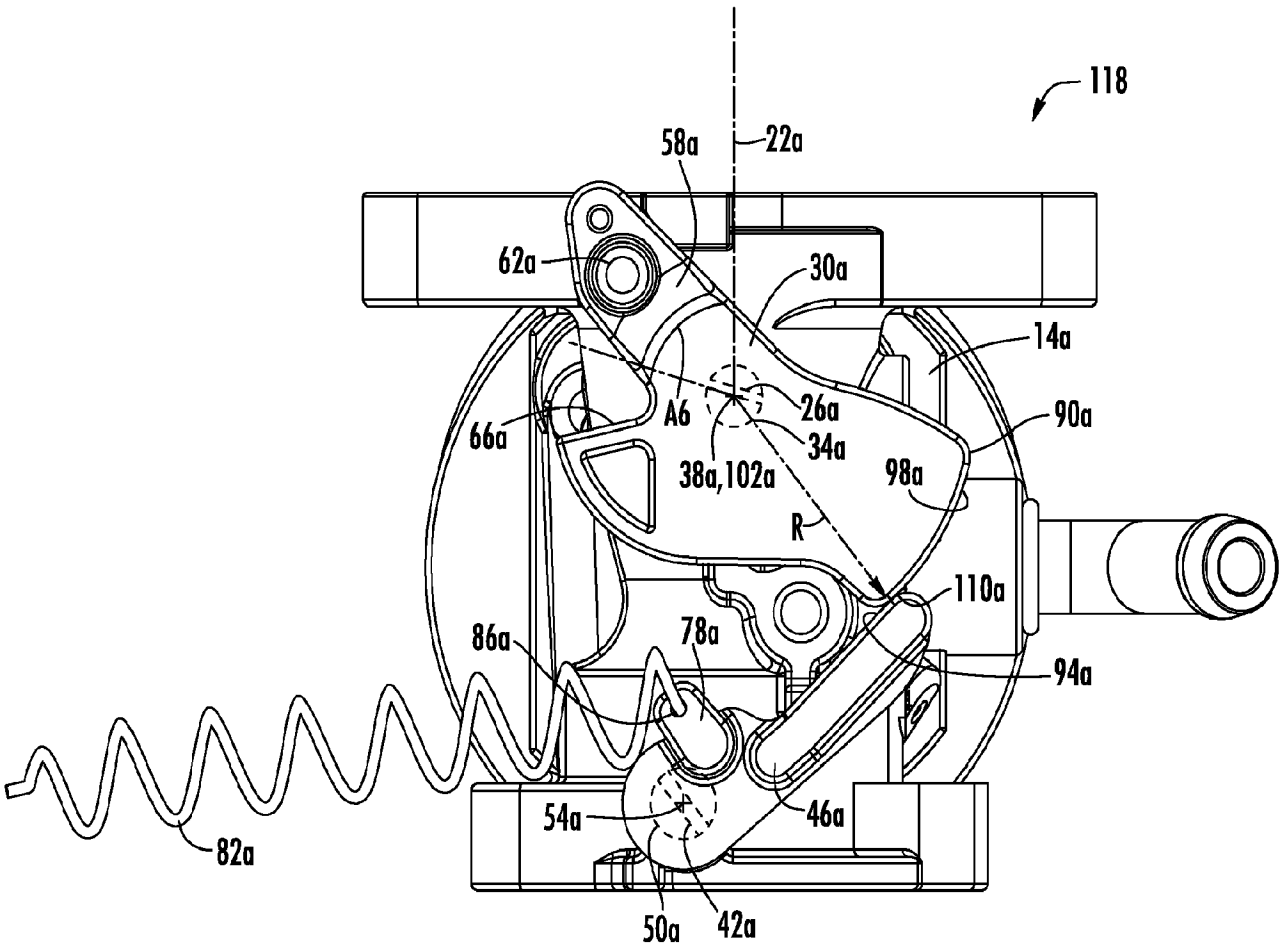
FIG. 9 is a top view of the carburetor of FIG. 6, illustrating the throttle lever in a third position corresponding with a second partially-closed position of the throttle valve.
Figure 10:
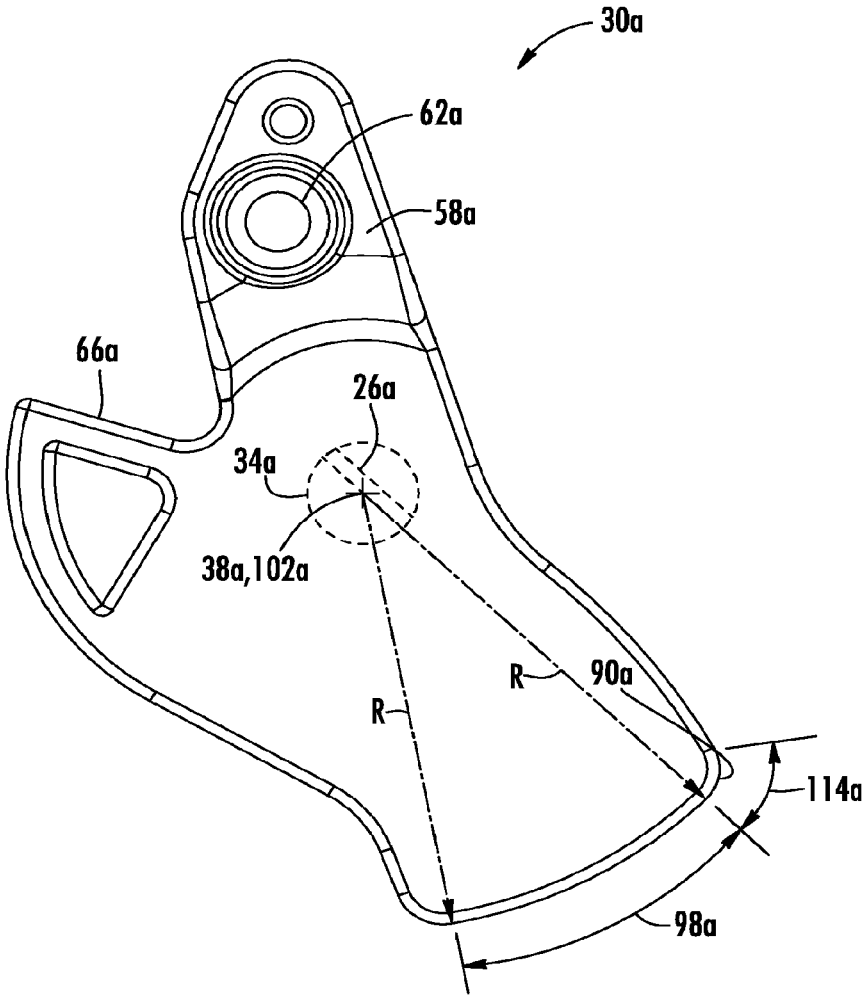
FIG. 10 is a top view of the throttle lever of the carburetor of FIG. 6.
Figure 11:
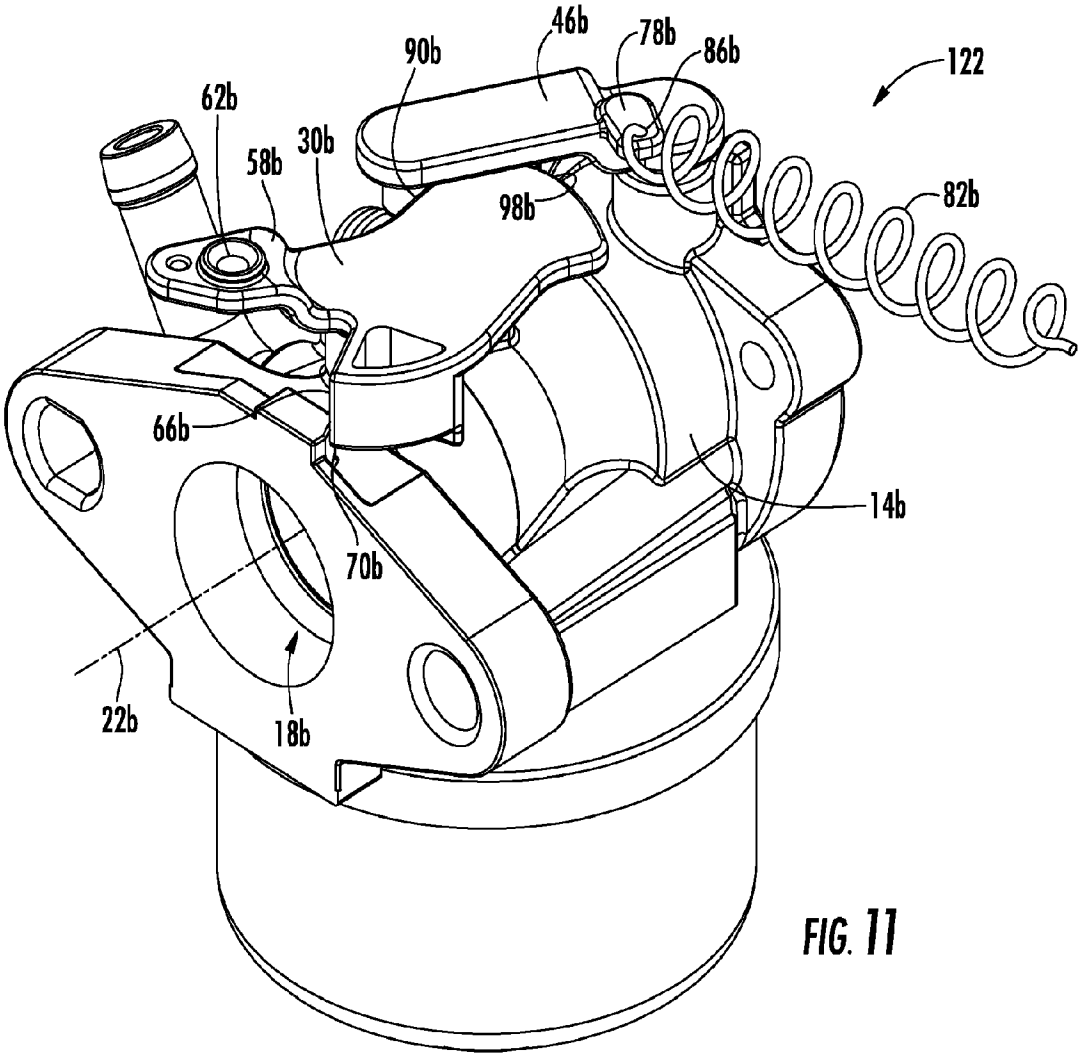
FIG. 11 is a top perspective view of a third construction of a carburetor of the present invention.
Figure 12:
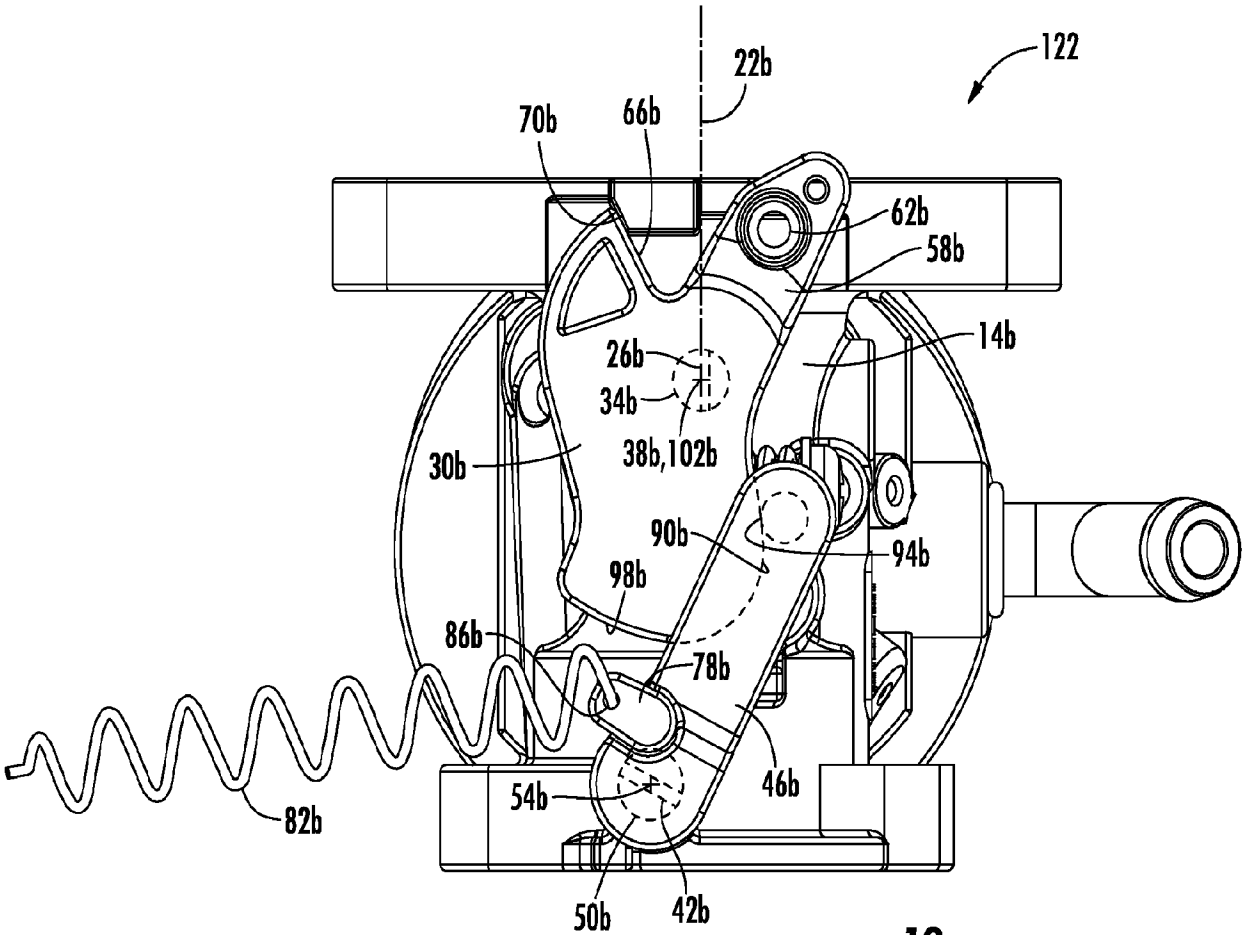
FIG. 12 is a top view of the carburetor of FIG. 11, illustrating a throttle lever in a first position corresponding with a fully-opened position of a throttle valve.
Figure 13:
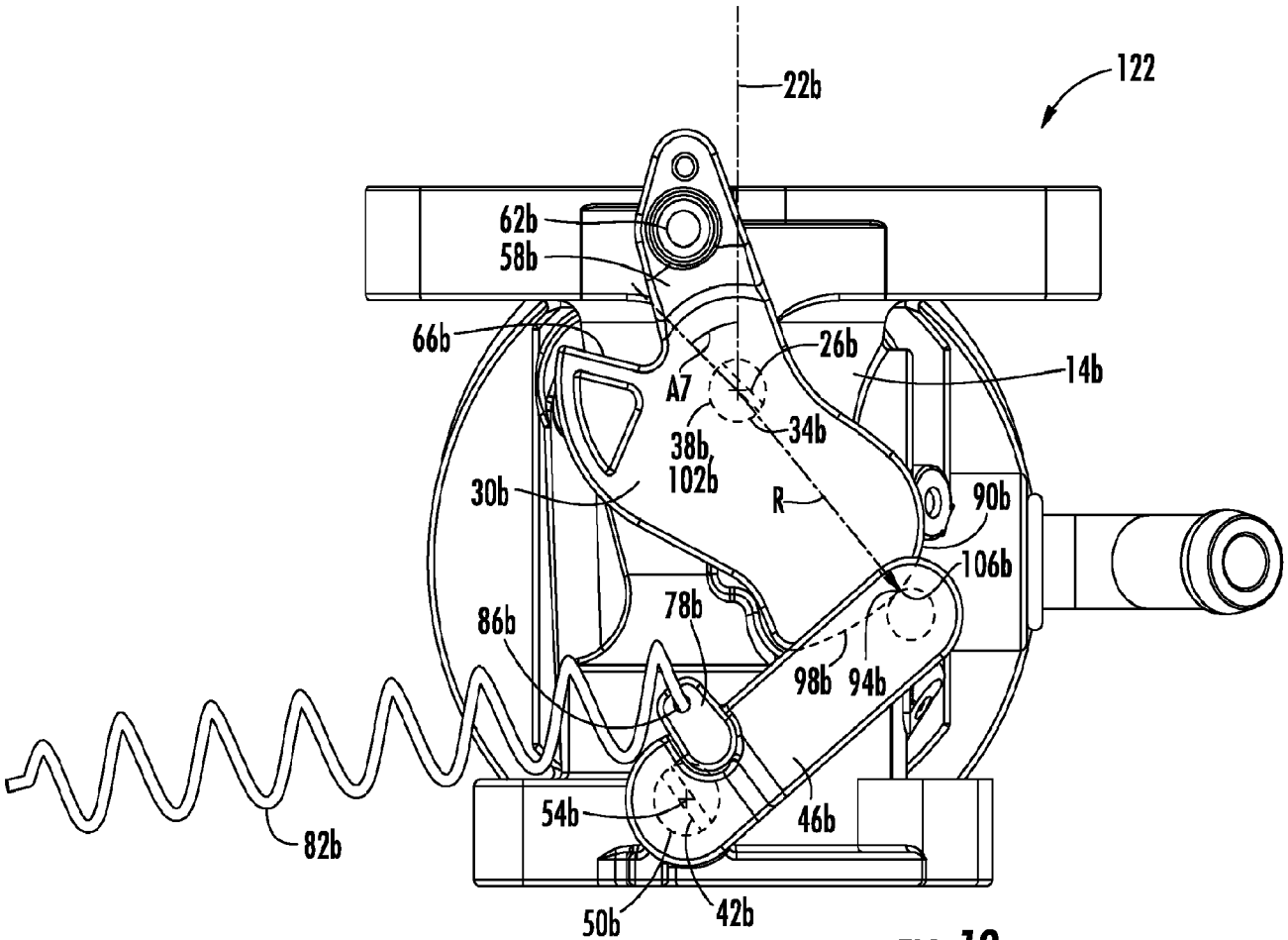
FIG. 13 is a top view of the carburetor of FIG. 11, illustrating the throttle lever in a second position corresponding with a first partially-closed position of the throttle valve.
Figure 14:
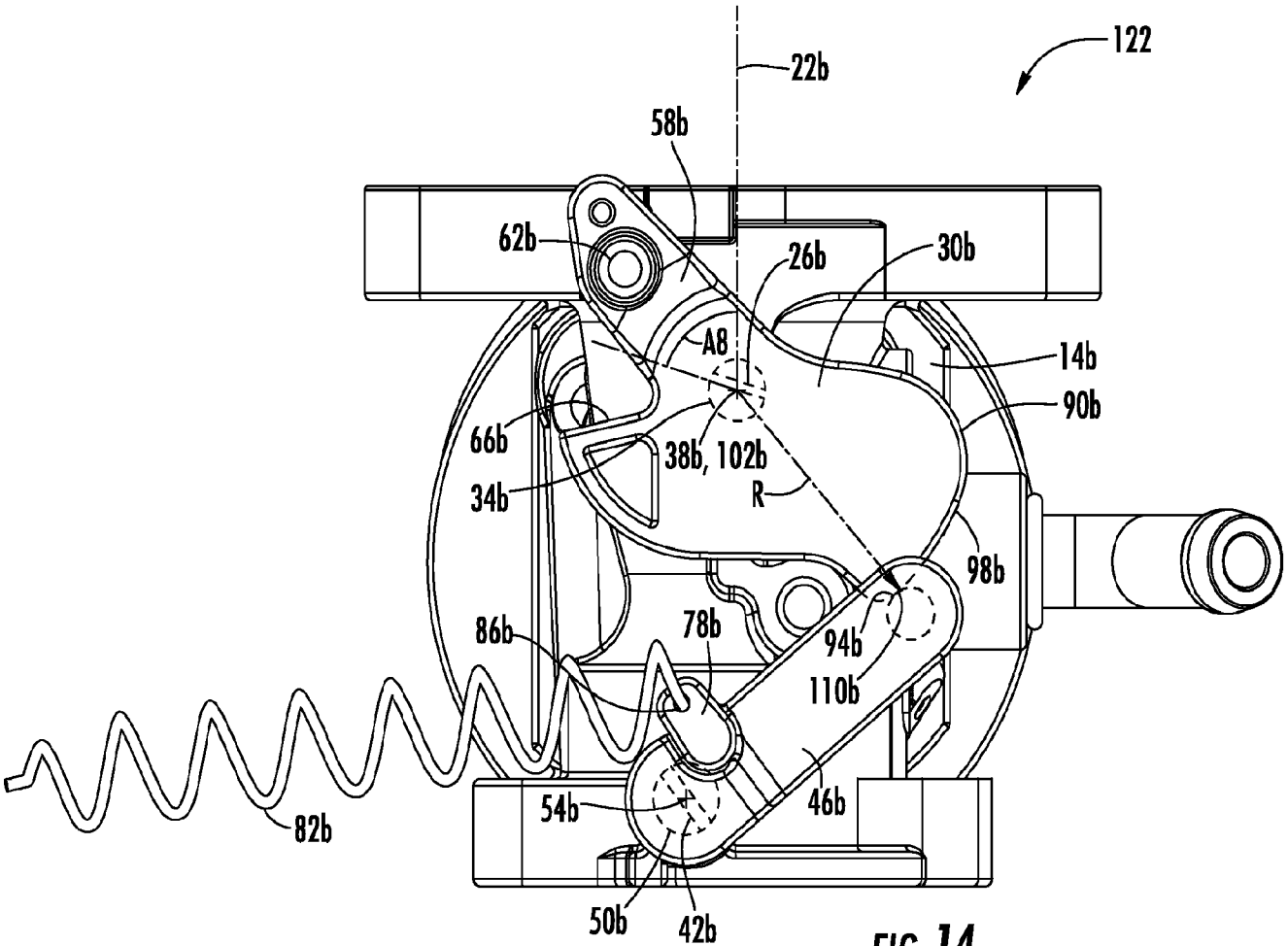
FIG. 14 is a top view of the carburetor of FIG. 11, illustrating the throttle lever in a third position corresponding with a second partially-closed position of the throttle valve.
Figure 15:
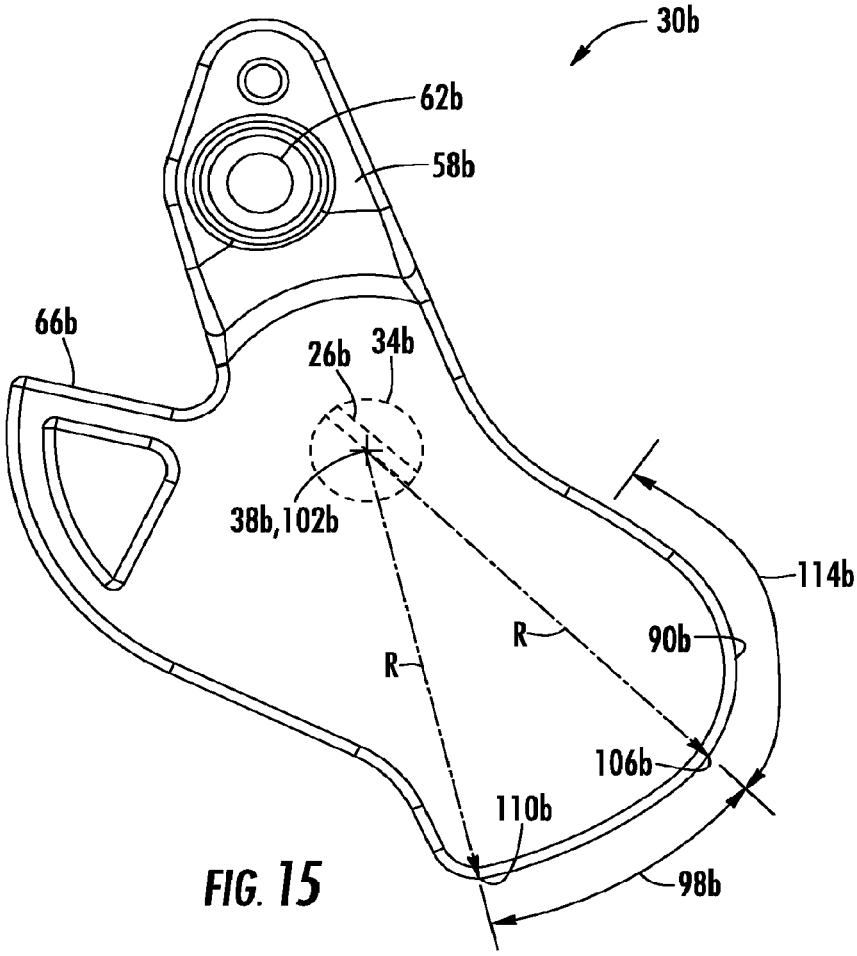
FIG. 15 is a top view of the throttle lever of the carburetor of FIG. 11.

With reference to FIGS. 2-4, the throttle lever 30 includes a cam surface 90 engaged with a follower surface 94 of the choke lever 46. As best shown in FIG. 5, the cam surface 90 includes an arcuate segment 98 having a constant radius R centered on an axis 102 substantially parallel with the axis 38 of the throttle lever 30. In the illustrated construction, the axis 102 is coaxial with the axis 38 of the throttle lever 30, such that a vector of the reaction force applied to the cam surface 90 by the follower surface 94, at any point along the arcuate segment 98, passes through or intersects the axis 38 of the throttle lever 30. Such a vector is also normal to a line tangent to the cam surface 90 and the follower surface 94 at that point of the arcuate segment 98.

With reference to FIG. 3, a first end 106 of the arcuate segment substantially coincides with a throttle valve angle A3 of about 47 degrees from the central axis 22. In other words, the follower surface 94 engages the cam surface 90 at a location coincident with the first end 106 of the arcuate segment 98 when the throttle valve 26 is moved to a throttle valve angle of about 47 degrees from the fully-opened position of the throttle valve 26 shown in FIG. 2. With reference to FIG. 4, a second end 110 of the arcuate segment 98 substantially coincides with a throttle valve angle A4 of about 75 degrees from the central axis 22. In other words, the follower surface 94 engages the cam surface 90 at a location coincident with the second end 110 of the arcuate segment 98 when the throttle valve 26 is moved to a throttle valve angle of about 75 degrees from the fully-opened position of the throttle valve 26 shown in FIG. 2. As such, the follower surface 94 engages the arcuate segment 98 over about 28 degrees of throttle valve opening, from the position of the throttle valve 26 shown in FIG. 3 to the position of the throttle valve 26 shown in FIG. 4. Alternatively, the arcuate segment 98 of the cam surface 90 may include a length less than that shown in FIG. 5, such that the follower surface 94 engages the arcuate segment 98 less than about 28 degrees, but at least 15 degrees, of throttle valve opening. Further, the arcuate segment 98 of the cam surface 90 may include a length greater than that shown in FIG. 5, such that the follower surface 94 engages the arcuate segment 98 more than about 28 degrees of throttle valve opening.

In an alternative construction of the carburetor 10, the axis 102 of the constant radius R may be slightly offset from the axis 38 of the throttle lever 30. As a result, a vector of the reaction force applied to the cam surface 90 by the follower surface 94, at any point along the arcuate segment 98, does not intersect the axis 38 of the throttle lever 30, but instead is disposed in close proximity to the axis 38 of the throttle lever 30. Such a configuration may result in a small, but acceptable reaction torque applied to the throttle lever 30 (e.g., not to exceed about 10 inch-grams) that does not significantly interfere with the operation of the governor.

In an engine incorporating the carburetor 10 of FIGS. 1-4, the throttle lever 30 is biased toward the position shown in FIG. 2 by the governor lever or a biasing member (e.g., a return spring) to orient the throttle valve 26 in a wide-open or fully-opened position in preparation for a cold-start of the engine. In addition, the choke lever 46 is biased toward the position shown in FIG. 2 by the spring 82 to orient the choke valve 42 in a closed position in preparation for a cold-start of the engine. Immediately after start-up of the engine, the governor actuates the governor lever to move the throttle lever 30 in a counter-clockwise direction, as shown in FIGS. 3 and 4, to move the throttle valve 26 to a particular position or throttle valve angle to achieve a desired no-load operating speed of the engine. In the illustrated configuration of the carburetor 10 in FIG. 4, the desired no-load operating speed of the engine is achieved by moving the throttle valve 26 to a position where it is about 75 degrees from the fully-opened position of the throttle valve 26 shown in FIG. 2. Alternatively, the carburetor 10 may be configured such that the desired no-load operating speed of the engine is achieved at a throttle valve angle corresponding with engagement of the cam surface 90 and follower surface 94 anywhere along the arcuate segment 98.

With reference to FIGS. 2-4, as the throttle lever 30 is pivoted from its position shown in FIG. 2 to its position shown in FIG. 4, the throttle lever 30 applies a force on the choke lever 46 to open the choke valve 42. As previously discussed, the spring 82 biases the choke lever 46 to a position in which the choke valve 42 is closed (see FIG. 2). As a result, the choke lever 46 applies a reaction force on the throttle lever 30 along a vector normal to a line tangent to both the cam surface 90 and the follower surface 94. When the reaction force is misaligned with the axis 38 of the throttle lever 30, the reaction force imparts a reaction torque on the throttle lever 30. FIG. 5 illustrates a range of engagement 114 of the cam surface 90 and the follower surface 94 along which the reaction force is misaligned with the axis 38 of the throttle lever 30. The magnitude of the reaction torque is dependent upon the geometry of the throttle lever 30 and the choke lever 46, and the spring rate of the spring 82.

With reference to FIGS. 3 and 4, however, the constant radius R of the arcuate segment 98 ensures that the vector of the reaction force applied to the cam surface 90 by the follower surface 94 is aligned or intersects the axis 38 of the throttle lever 30. As a result, the reaction force applied to the throttle lever 30 cannot impart a corresponding reaction torque on the throttle lever 30 to impede or otherwise affect the movement of the throttle lever 30 within the range of engagement of the cam surface 90 and follower surface 94 along the arcuate segment 98 (see also FIG. 5). By substantially eliminating the reaction torque on the throttle lever 30 within the range of engagement of the cam surface 90 and follower surface 94 along the arcuate segment 98, the carburetor 10 may be configured to provide a wide range of selected desired no-load operating speeds of an engine within which interference with the governor's control of the throttle lever 30 is minimized or prevented. In addition, the throttle lever 30 may move within the range of engagement of the cam surface 90 and follower surface 94 along the arcuate segment 98 in response to engine loading, without substantial interference with the governor's control of the throttle lever 30 by the reaction force applied to the throttle lever 30 by the choke lever 46.

After the engine has started, the thermally conductive assembly may be activated to further pivot the choke lever 46 to disengage the choke lever 46 from the throttle lever 30, and maintain the choke lever 46 in a position in which the choke valve 42 is fully opened. During a hot-restart of the engine, the thermally conductive assembly may remain activated to maintain the choke valve 42 in its fully-opened position.

Figure 30:
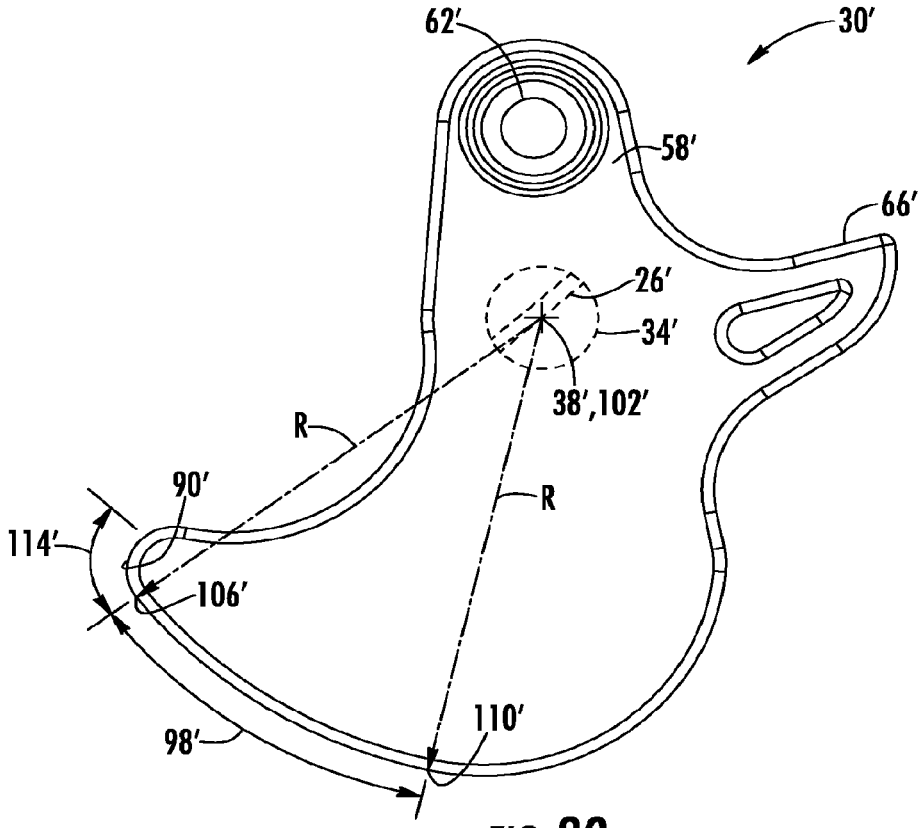
FIG. 30 is a top view of the throttle lever of the carburetor of FIG. 26.

FIGS. 26-29 illustrate a carburetor 10' that is substantially similar to the carburetor 10 shown in FIGS. 1-4. Like components are labeled with like reference numerals, plus a prime symbol, and will not be described again in detail. However, the throttle lever 30', upon rotation about its axis 38' in a clockwise direction to close the throttle valve 26', is configured to engage and rotate the choke lever 46' about its axis 54' in a counter-clockwise direction to open the choke valve 42' (see FIGS. 27-29). As such, the throttle lever 30' is configured to rotate in a direction opposite the throttle lever 30 to close the throttle valve 26', and the choke lever 46' is configured to rotate in a direction opposite the choke lever 46 to open the choke valve 42'. As shown in FIG. 30, the throttle lever 30' is a mirror image of the throttle lever 30 illustrated in FIG. 5.

FIGS. 6-9 illustrate a second construction of a carburetor 118 configured for use with a small engine. Like components are labeled with like reference numerals, plus the letter "a," and will not be described again in detail. The operation of the carburetor 118 is substantially similar to the carburetor 10 of FIGS. 1-4. However, the shape of the cam surface **90*a* within the range of engagement 114*a* of the cam surface 90*a* and follower surface 94*a* along which the reaction force is misaligned with the axis 38*a* of the throttle lever 30*a* (i.e., between the fully-opened position of the throttle valve 26*a*** and a throttle valve angle A5 of about 40 degrees from the central axis 22*a*; see FIG. 8) provides a different reaction torque curve (e.g., reaction torque versus throttle valve angle) than the curve resulting from the configuration of the throttle lever 30 of FIGS. 1-5. In addition, the arcuate segment 98*a* has a length such that the follower surface 94*a* engages the arcuate segment 98*a* over about 35 degrees of throttle valve opening, from the position of the throttle valve 26*a* shown in FIG. 8 to the position of the throttle valve 26*a* shown in FIG. 9, in which the throttle valve 26*a* has a throttle valve angle A6 of about 75 degrees from the central axis 22*a*.

FIGS. 11-14 illustrate a third construction of a carburetor 122 configured for use with a small engine. Like components are labeled with like reference numerals, plus the letter "b," and will not be described again in detail. The operation of the carburetor 122 is substantially similar to the carburetors 10, 118 of FIGS. 1-4 and FIGS. 6-9, respectively. However, the shape of the cam surface 90*b* within the range of engagement 114*b* of the cam surface 90*b* and follower surface 94*b* along which the reaction force is misaligned with the axis 38*b* of the throttle lever 30*b* (i.e., between the fully-opened position of the throttle valve 26*b* and a throttle valve angle A7 of about 47 degrees from the central axis 22*b*; see FIG. 13) provides a different reaction torque curve (e.g., reaction torque versus throttle valve angle) than the curve resulting from the configuration of the throttle lever 30 of FIGS. 1-5. In addition, the arcuate segment 98*b* has a length such that the follower surface 94*b* engages the arcuate segment 98*b* over about 28 degrees of throttle valve opening, from the position of the throttle valve 26*b* shown in FIG. 13 to the position of the throttle valve 26*b* shown in FIG. 14, in which the throttle valve 26*b* has a throttle valve angle A8 of about 75 degrees from the central axis 22*b*.

FIGS. 16-20 illustrate a fourth construction of a carburetor 126 configured for use with a small engine. The carburetor 126 includes a body 130 defining an air/fuel passageway 134 along a central axis 138. The carburetor 126 also includes a throttle valve 142 positioned in the passageway 134 and a throttle lever 146 coupled to the throttle valve 142 via a throttle shaft 150. The throttle valve 142, throttle shaft 150, and throttle lever 146 are pivotable about an axis 154 oriented substantially normal to the central axis 138 of the passageway 134. The carburetor 126 also includes a choke valve 158 positioned in the passageway 134 and a choke lever 162 coupled to the choke valve 158 via a choke shaft 166. The choke valve 158, choke shaft 166, and choke lever 162 are also pivotable about an axis 178 oriented substantially normal to the central axis 138 of the passageway 134.

With continued reference to FIGS. 16-20, the carburetor 126 also includes an intermediate lever 174 coupled to the body 130 and pivotable about an axis 178 oriented substantially normal to the central axis 138 of the passageway 134. The intermediate lever 174 includes a first arm 182 having a follower surface 186 and a second arm 190 having a cam surface 194. As discussed in more detail below, the intermediate lever 174 transfers the movement of the throttle lever 146 to the choke lever 162 to move the choke valve 158. The intermediate lever 174 may also be coupled to a thermally conductive assembly selectively operable to hold or maintain the intermediate lever 174 and therefore the choke lever 162, in a position in which the choke valve 158 is fully opened. Such a thermally conductive assembly is disclosed in U.S. Pat. No. 6,990,969, the entire content of which is incorporated herein by reference.

Figure 18:
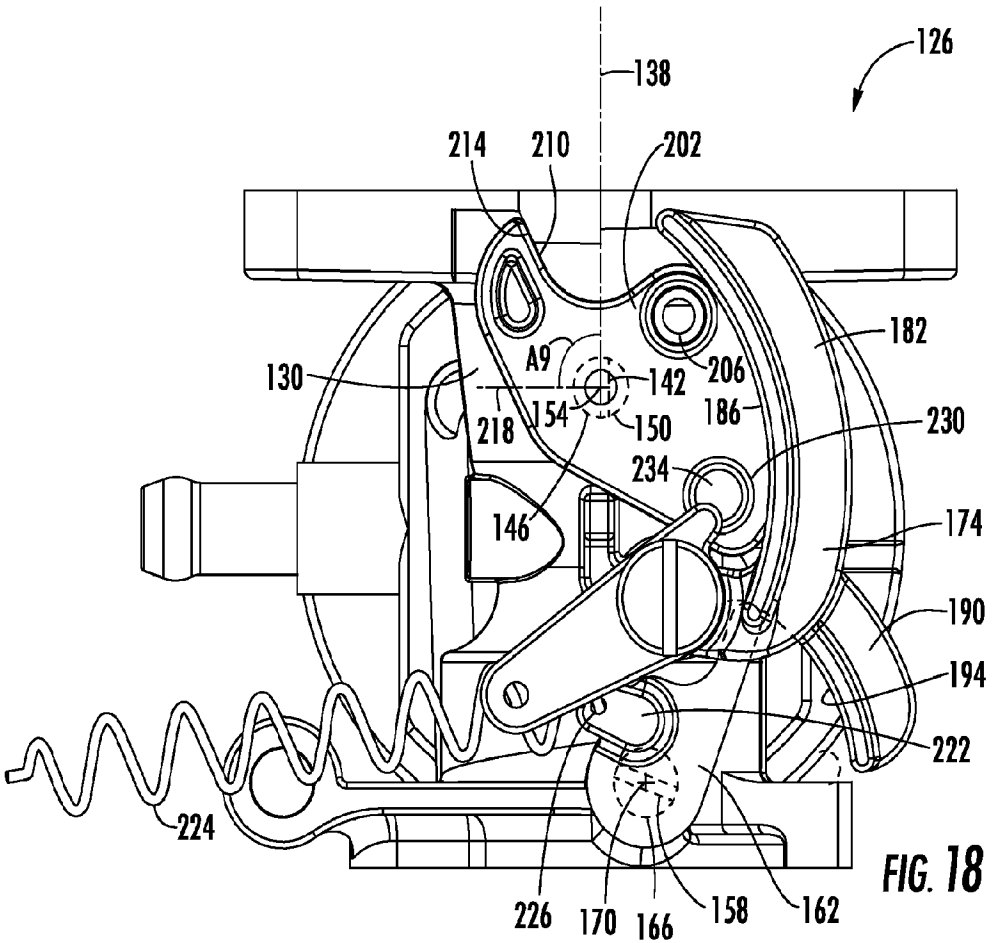
FIG. 18 is a top view of the carburetor of FIG. 16, illustrating a throttle lever in a first position corresponding with a fully-opened position of a throttle valve.
Figure 19:
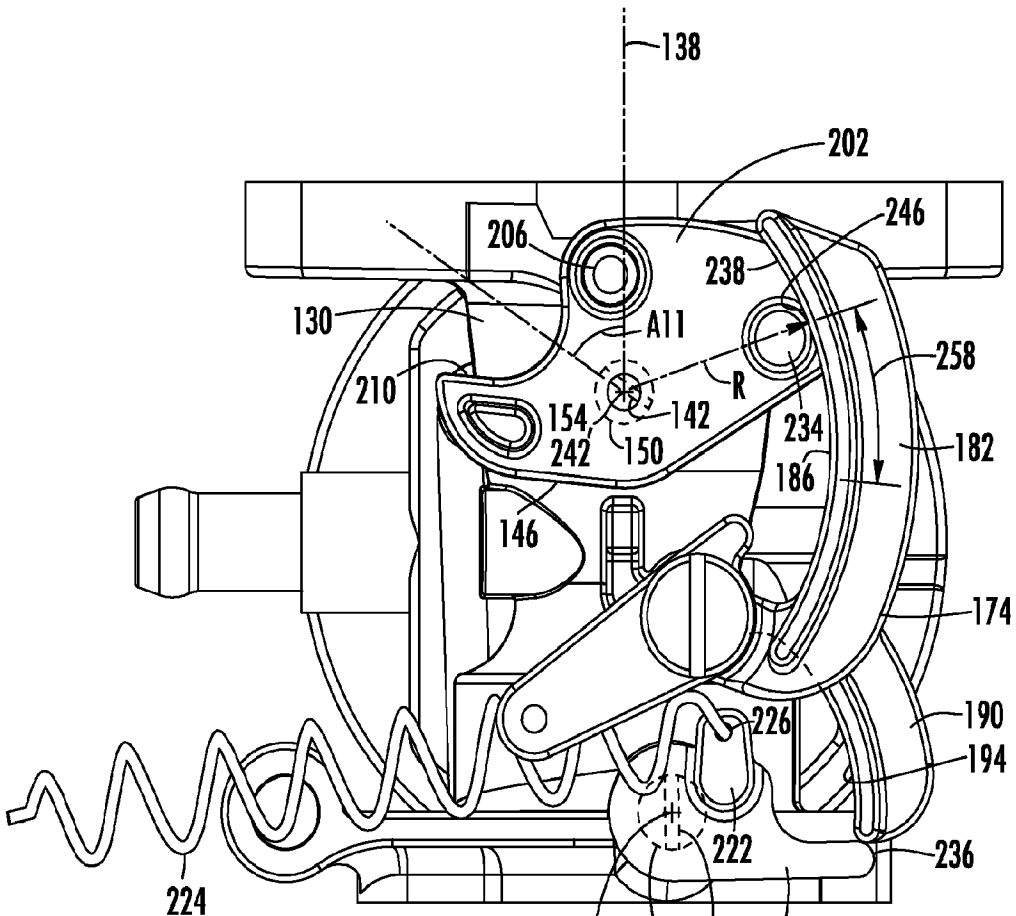
FIG. 19 is a top view of the carburetor of FIG. 16, illustrating the throttle lever in a second position corresponding with a first partially-closed position of the throttle valve.
Figure 20:
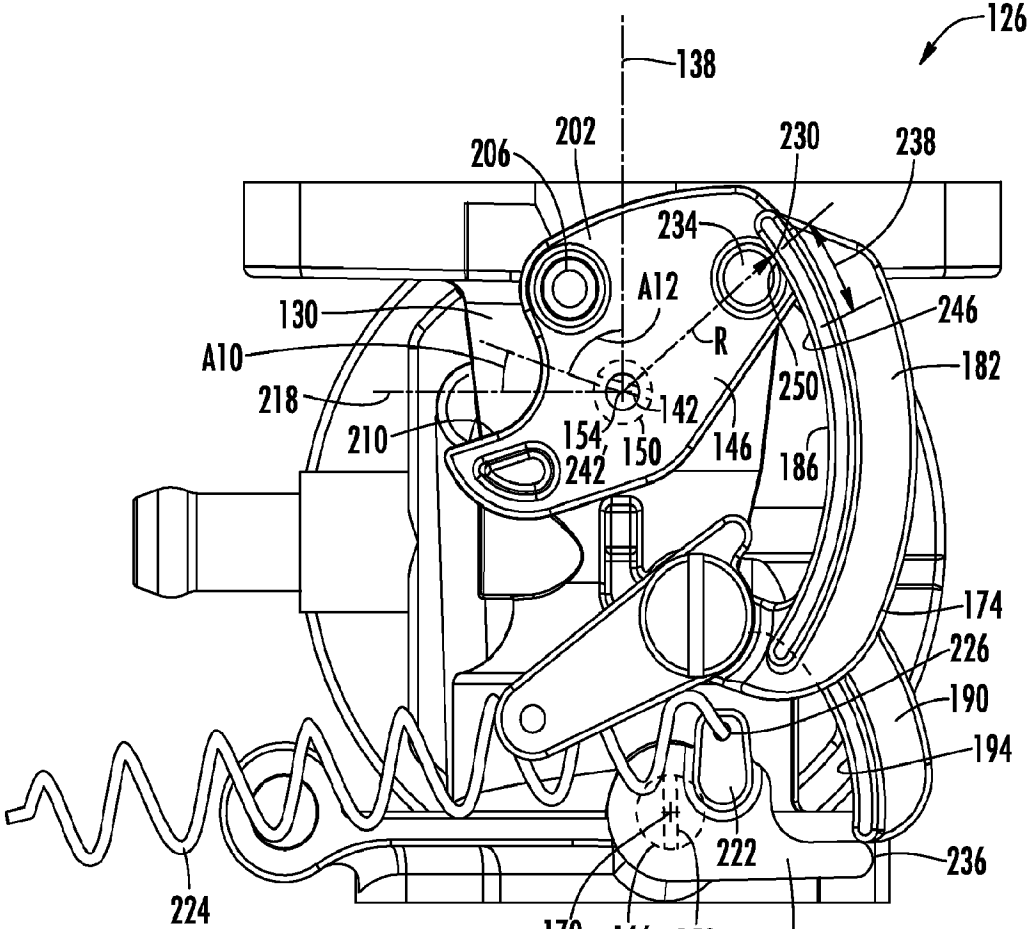
FIG. 20 is a top view of the carburetor of FIG. 16, illustrating the throttle lever in a third position corresponding with a second partially-closed position of the throttle valve.
Figure 21:
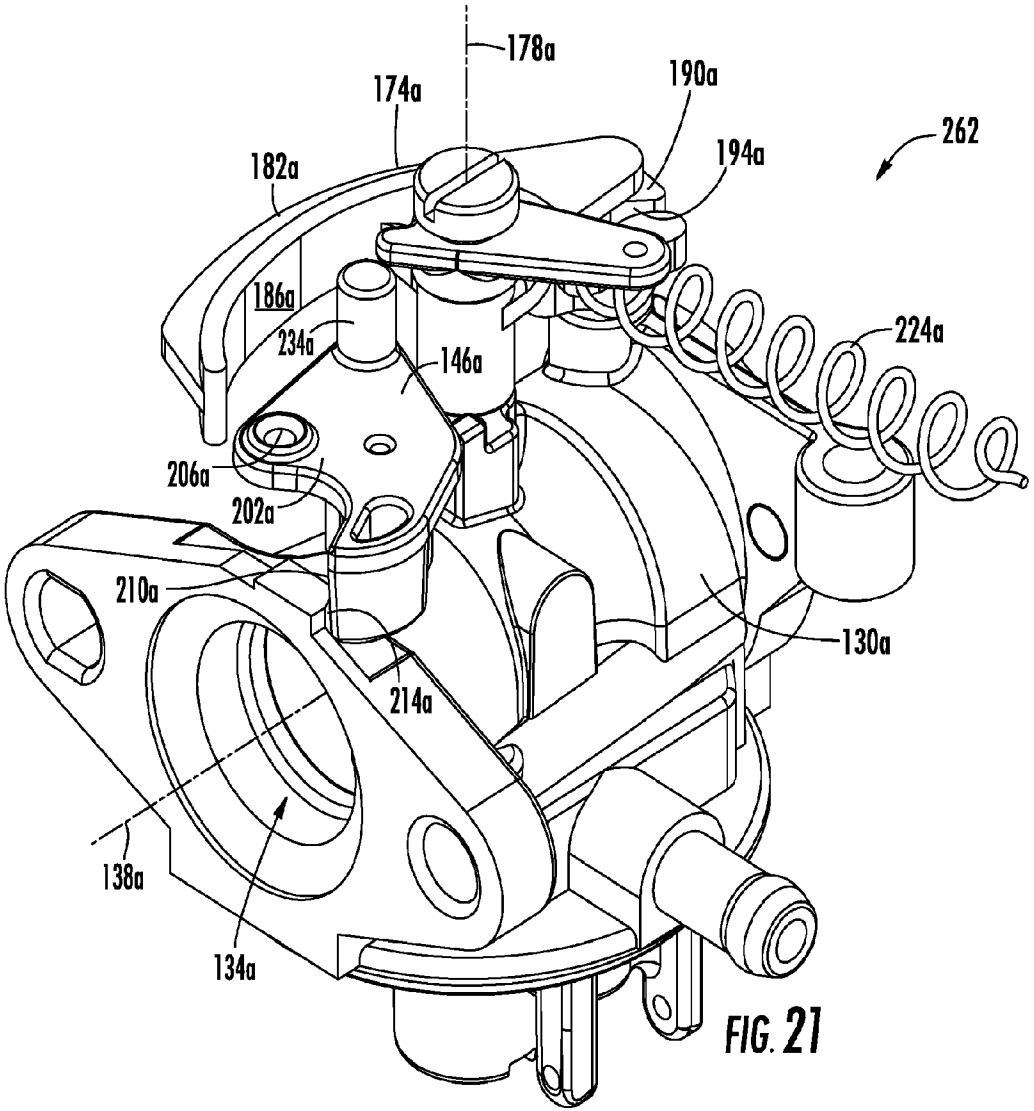
FIG. 21 is a top perspective view of a fifth construction of a carburetor of the present invention.
Figure 22:
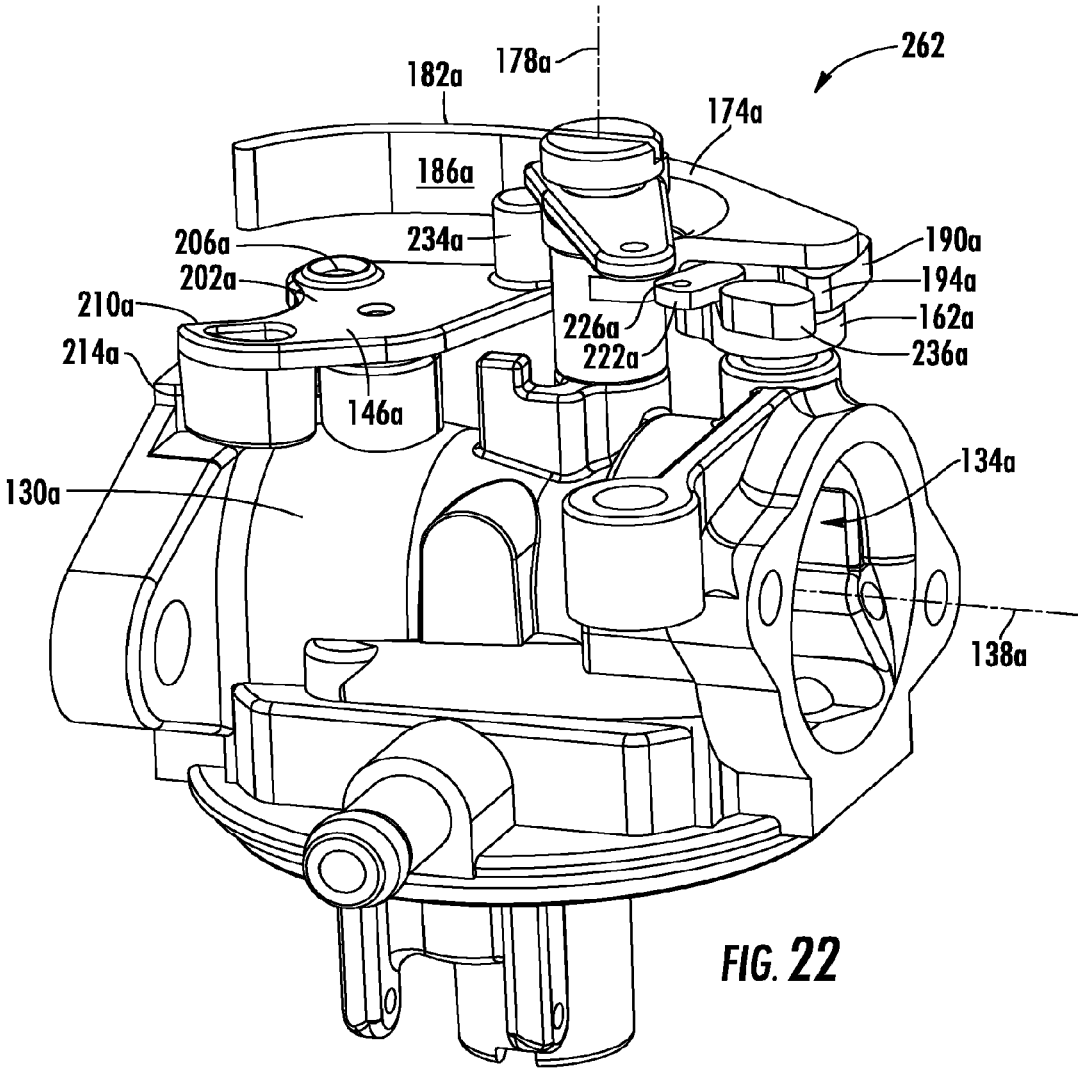
FIG. 22 is a reverse, top perspective view of the carburetor of FIG. 21.
Figure 23:
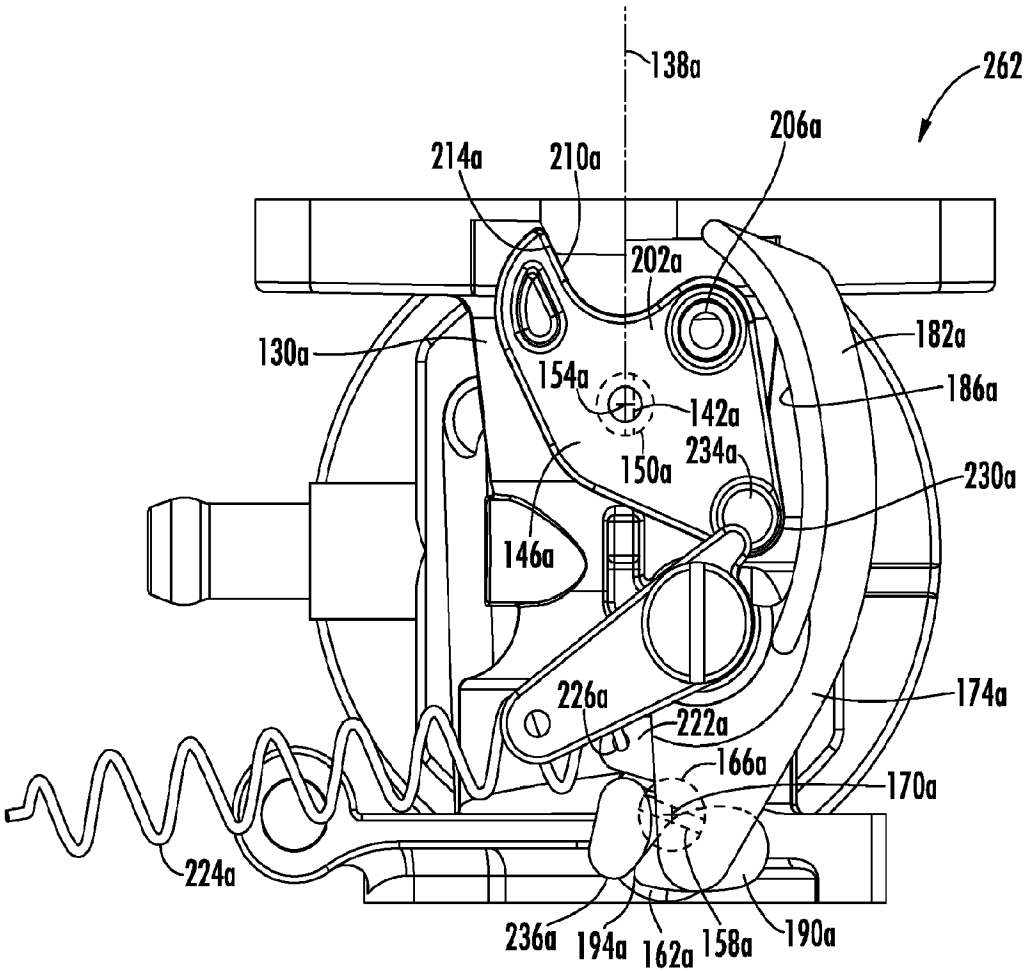
FIG. 23 is a top view of the carburetor of FIG. 21, illustrating a throttle lever in a first position corresponding with a fully-opened position of a throttle valve.
Figure 24:
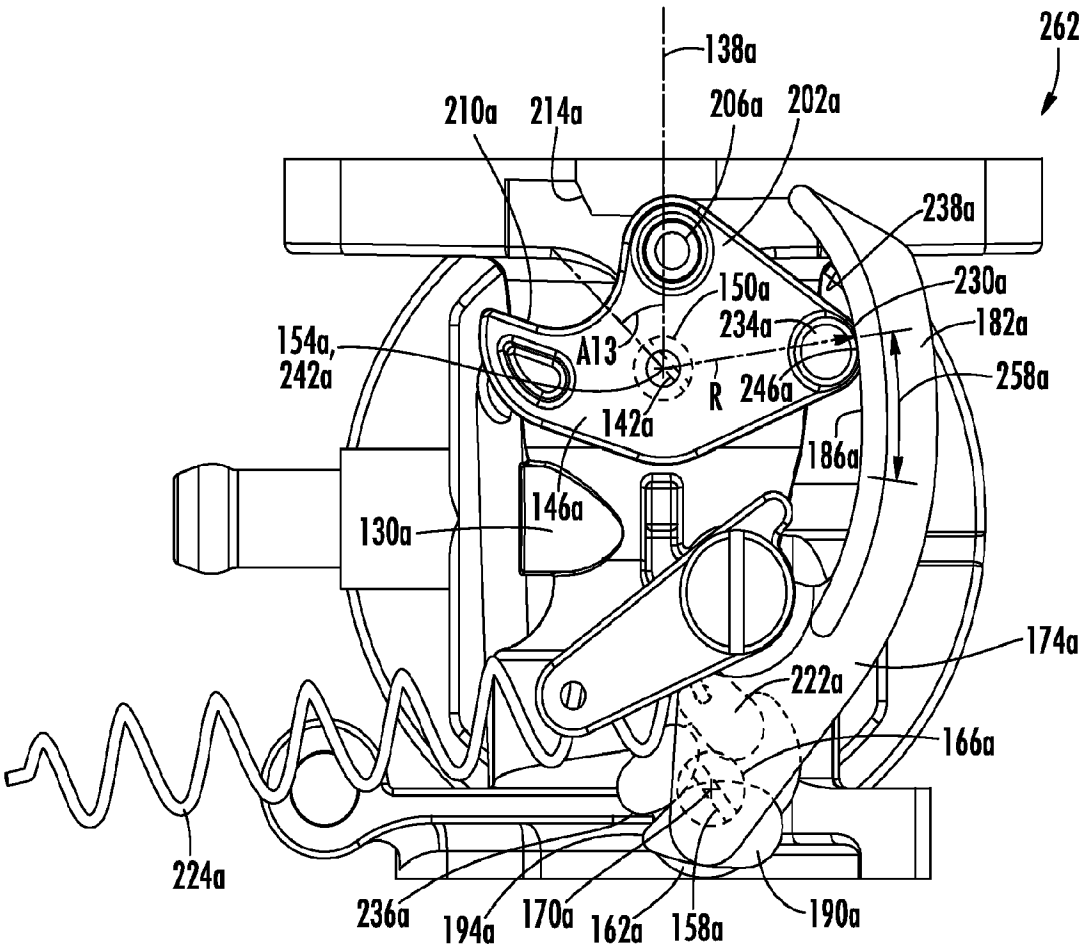
FIG. 24 is a top view of the carburetor of FIG. 21 illustrating the throttle lever in a second position corresponding with a first partially-closed position of the throttle valve.
Figure 25:
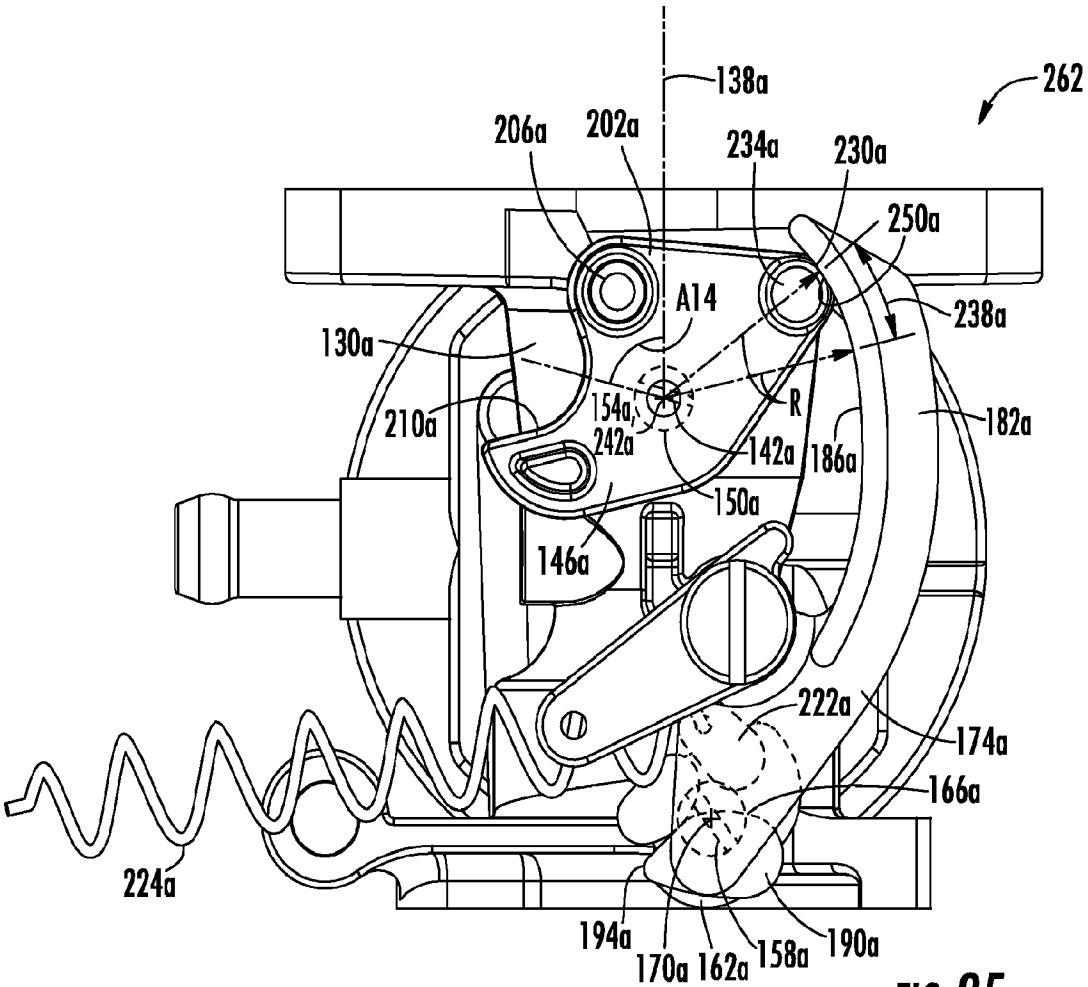
FIG. 25 is a top view of the carburetor of FIG. 21, illustrating the throttle lever in a third position corresponding with a second partially-closed position of the throttle valve.
Figure 26:
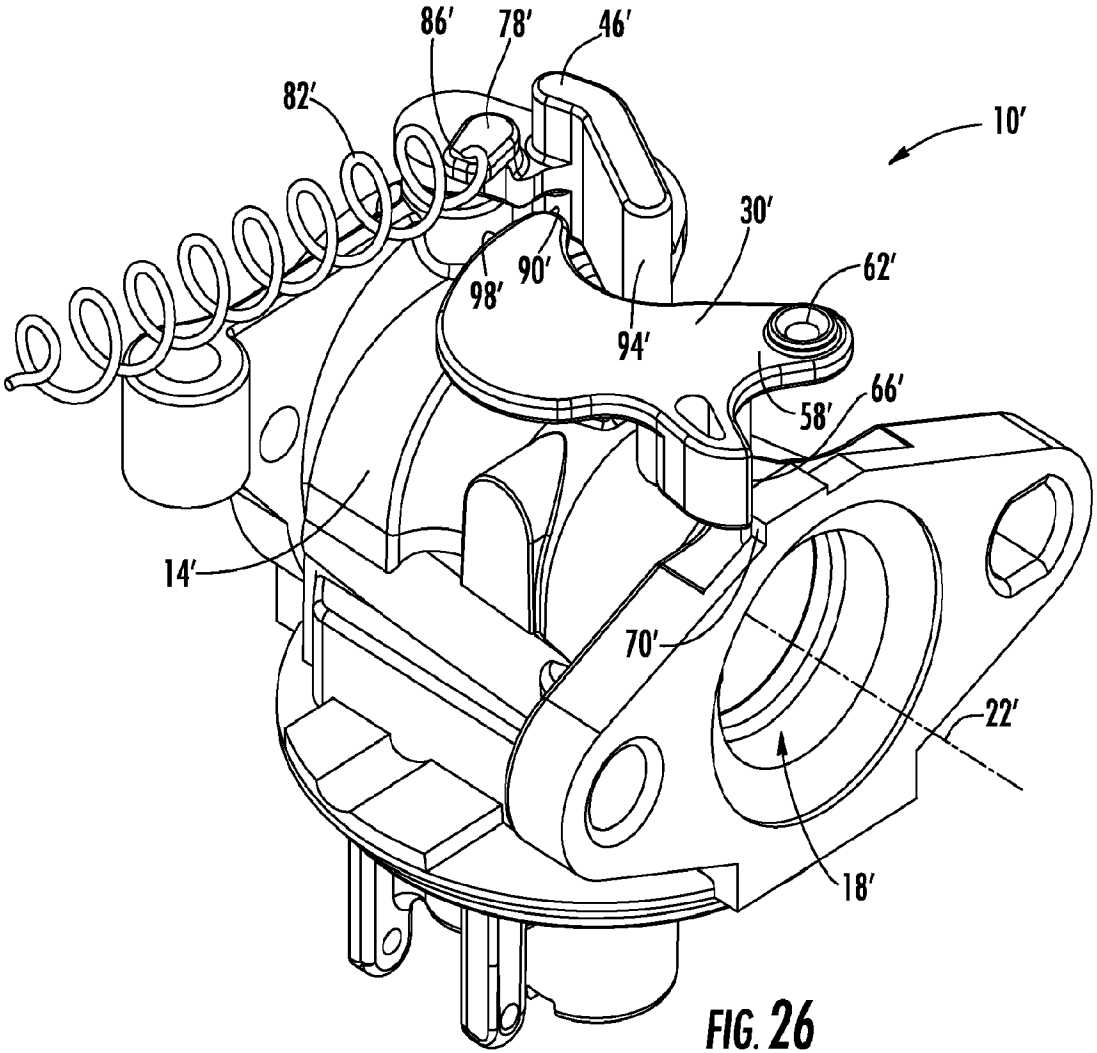
FIG. 26 is a top perspective view of a sixth construction of a carburetor of the present invention.
Figure 27:
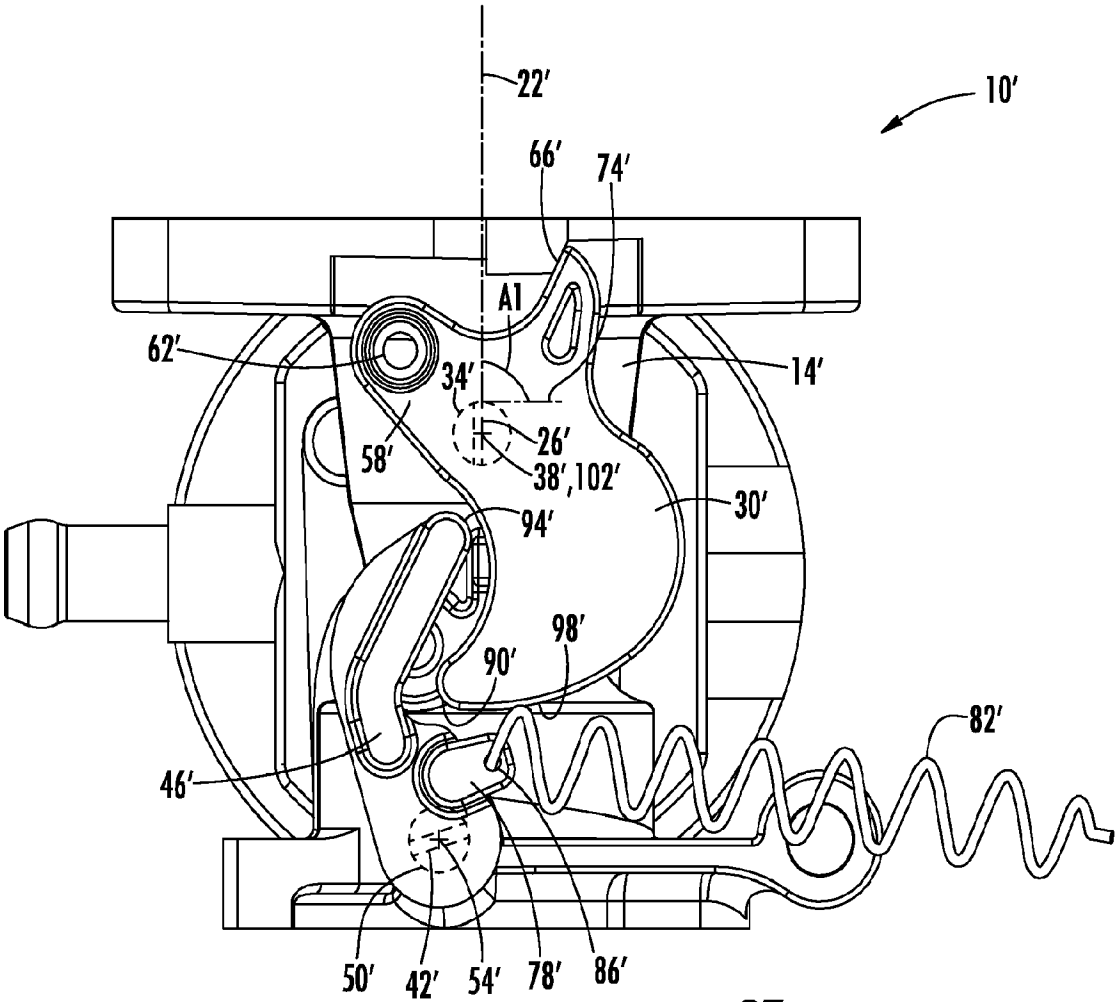
FIG. 27 is a top view of the carburetor of FIG. 26, illustrating a throttle lever in a first position corresponding with a fully-opened position of a throttle valve.
Figure 28:
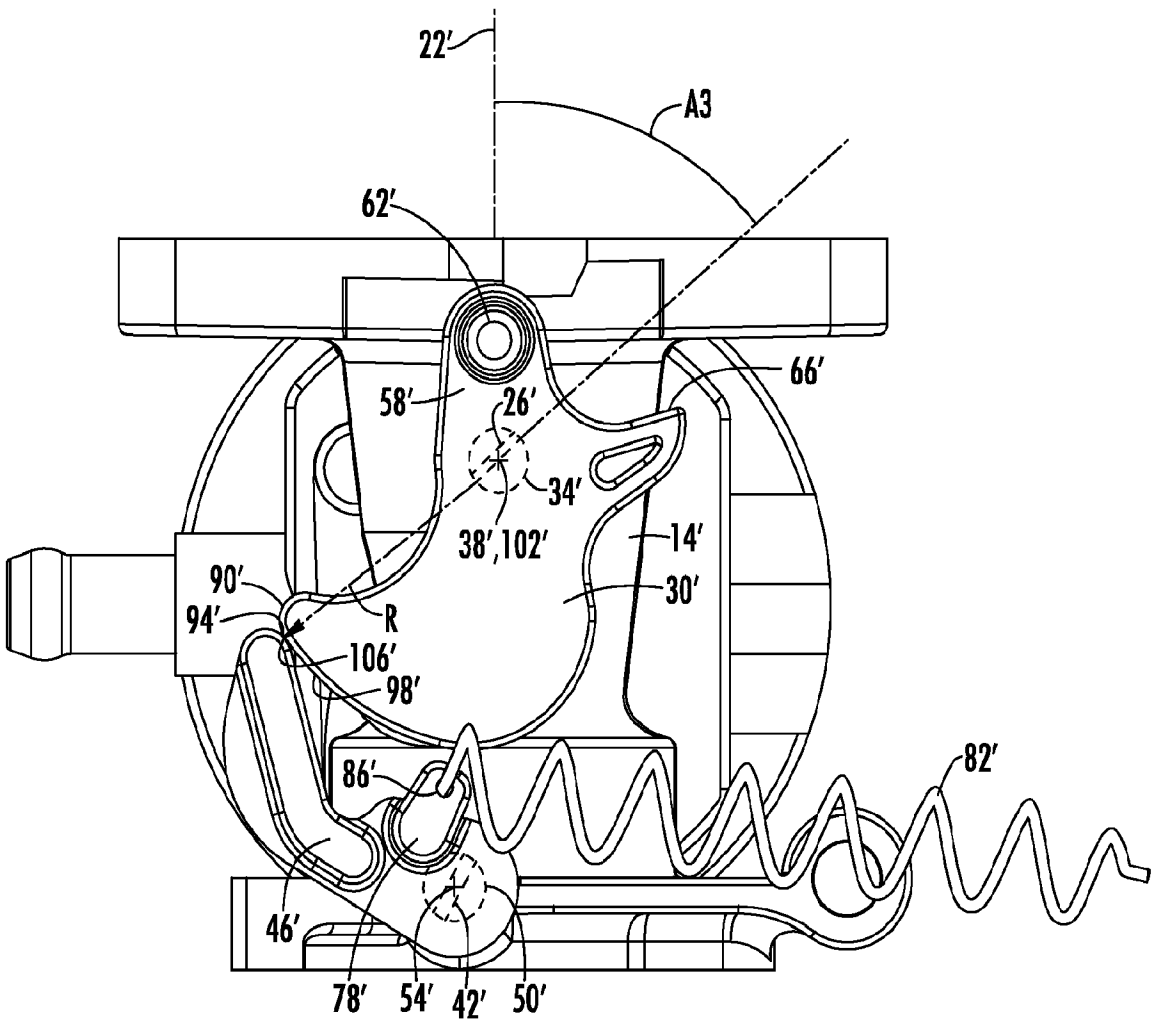
FIG. 28 is a top view of the carburetor of FIG. 26, illustrating the throttle lever in a second position corresponding with a first partially-closed position of the throttle valve.
Figure 29:
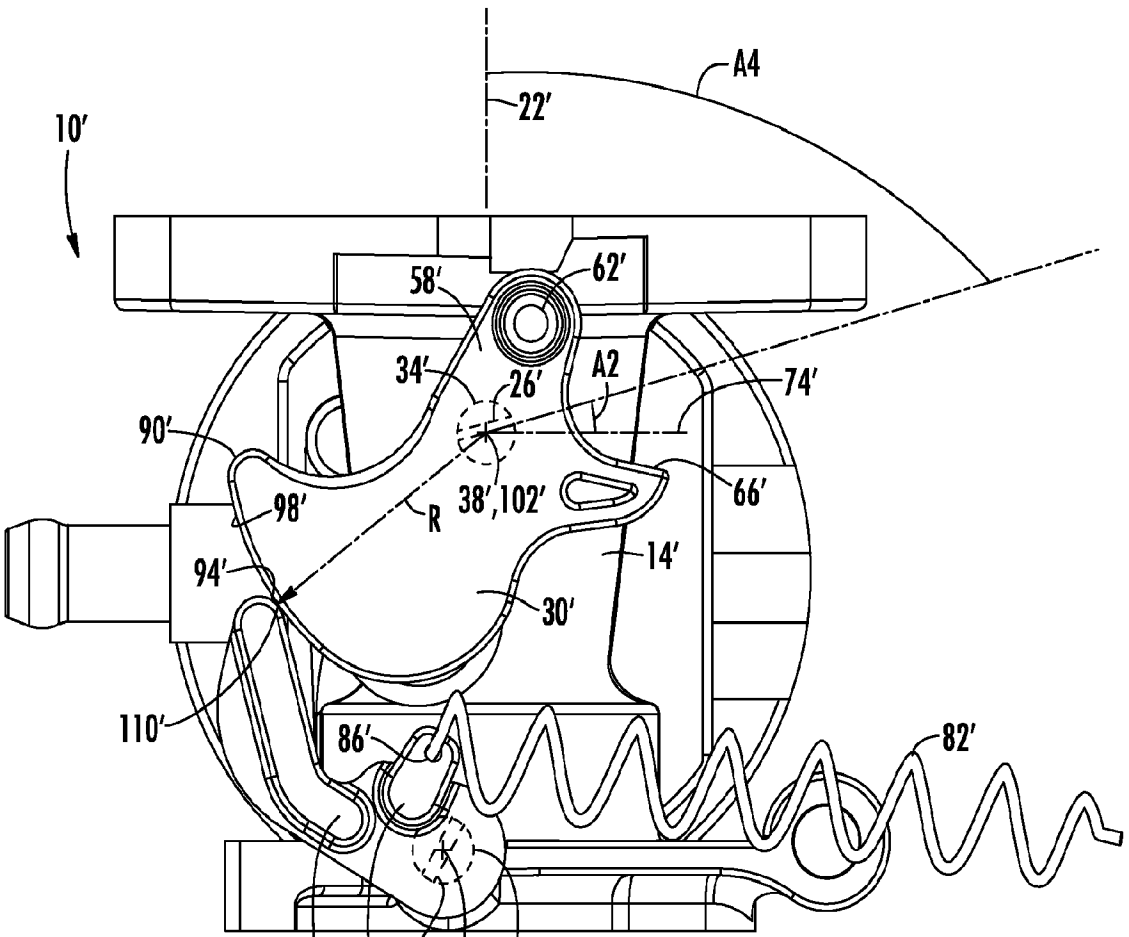
FIG. 29 is a top view of the carburetor of FIG. 26, illustrating the throttle lever in a third position corresponding with a second partially-closed position of the throttle valve.

With reference to FIGS. 18-20, the throttle lever 146 includes an arm 202 coupled to a governor lever (not shown) of the engine, which, in turn, is selectively actuated by another component of a governor in the engine to open and close the throttle valve 142. In the illustrated construction of the throttle lever 146, the arm 202 includes an aperture 206 to facilitate coupling of the governor lever to the throttle lever 146 (e.g., by a fastener). Alternatively, the arm 202 may be coupled to the governor lever in other ways.

Figure 16:
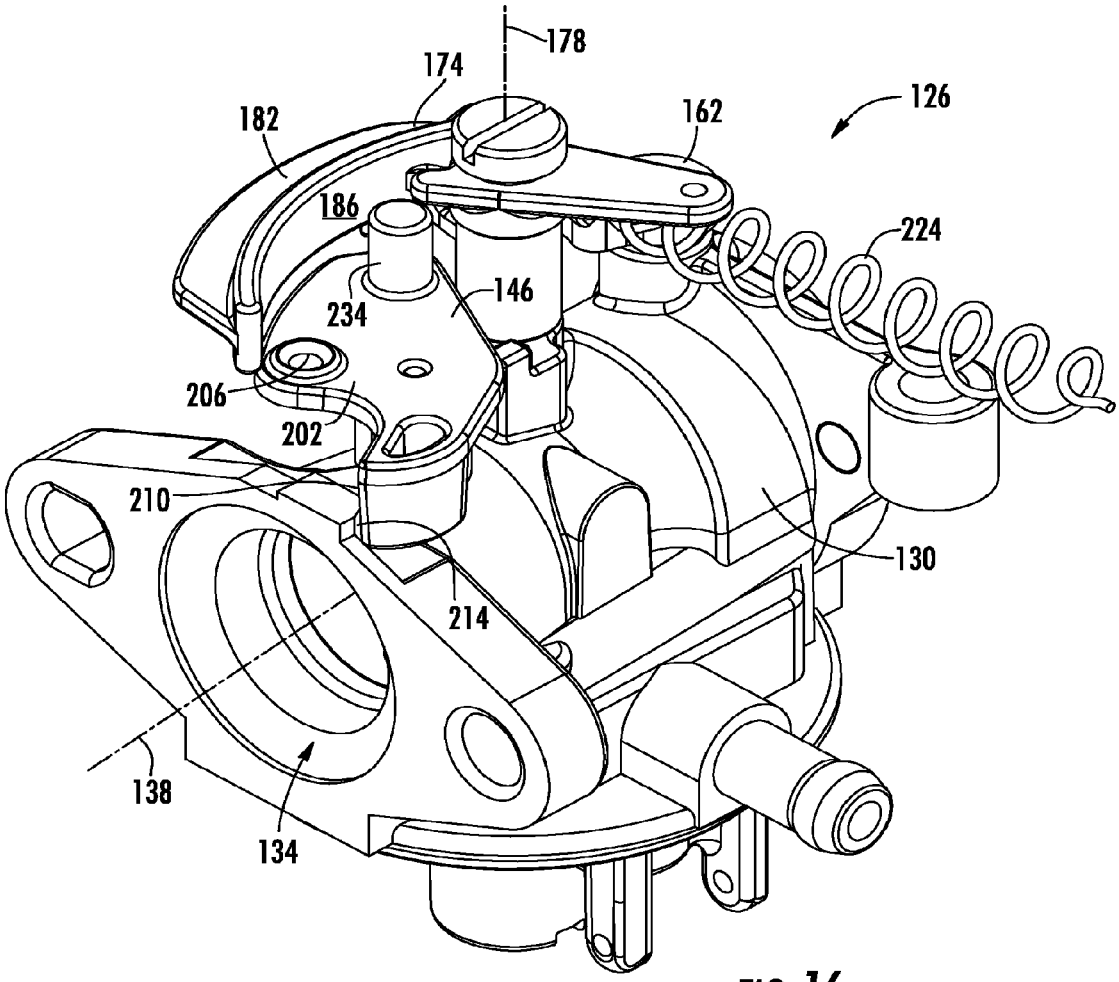
FIG. 16 is a top perspective view of a fourth construction of a carburetor of the present invention.
Figure 17:
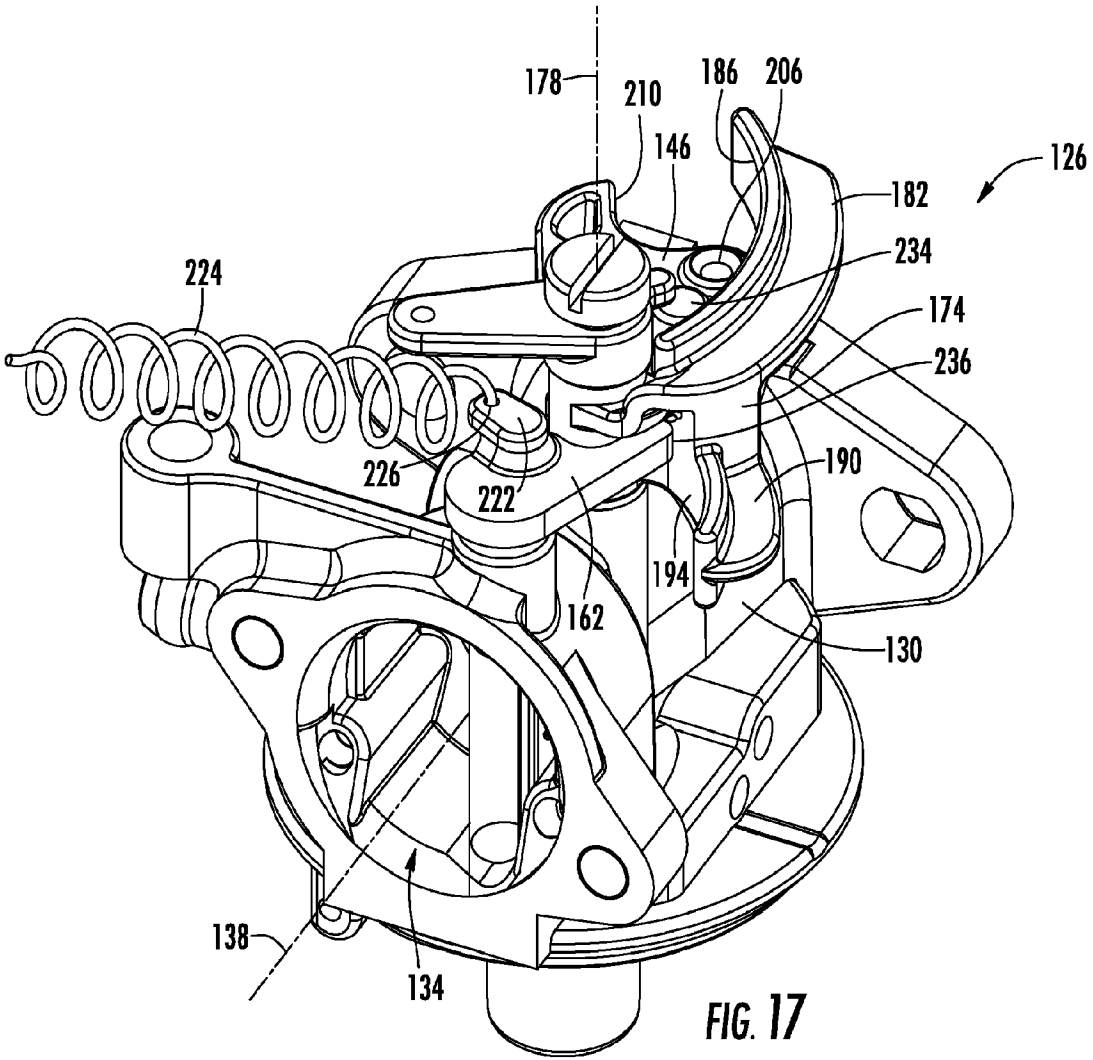
FIG. 17 is a reverse, top perspective view of the carburetor of FIG. 16.

With reference to FIGS. 16 and 17, the throttle lever 146 also includes a stop 210 configured to engage different portions of the body 130 to limit the extent to which the throttle valve 142 may be opened and closed. In one construction of the carburetor 126, the stop 210 may engage a protrusion 214 on the carburetor 126 to limit the opening of the throttle valve 142. The stop 210 may also engage a screw threaded to a portion of the body 130 to limit the closing of the throttle valve 142. The protrusion 214 may be sized and positioned to limit the opening of the throttle valve 142 to a throttle angle A9 of about 90 degrees measured from a plane 218 normal to the central axis 138 of the passageway 134 (see FIG. 18). In other words, the protrusion 214 may be sized and positioned to limit the opening of the throttle valve 142 to an orientation in which the throttle valve 142 is substantially parallel to the central axis 138. In this position, the throttle valve 142 is "wide open" or fully opened to allow the maximum amount of airflow through the passageway 134. The screw may be adjusted relative to the body 130, for example, to limit the closing of the throttle valve 142 to a throttle angle A10 of about 15 degrees measured from the plane 218 (i.e., about 75 degrees from the central axis 138; see FIG. 20). Alternative constructions of the carburetor 126 may utilize any of a number of different structures and components to limit the opening and closing of the throttle valve 142.

With reference to FIGS. 17-20, the choke lever 162 includes an arm 222 configured to be coupled to a biasing member (e.g., a spring 224). The arm 222 includes an aperture 226 through which a portion of the spring 224 is inserted to couple the spring 224 to the arm 222. The arm 222 is positioned on the choke lever 162 such that the spring 224 applies a torque on the choke lever 162 about its axis 170 in a counterclockwise direction, as shown in FIGS. 18-20, to bias the choke valve 158 toward a closed position.

With reference to FIGS. 19 and 20, the throttle lever 146 includes a cam surface 230 engaged with the follower surface 186 on the first arm 182 of the intermediate lever 174. In the illustrated construction of the carburetor 126, the cam surface 230 is located on a projection 234 upstanding from the throttle lever 146 (see FIGS. 16 and 17). Alternatively, the cam surface 230 may be located directly on the throttle lever 146, in a manner similar to the respective cam surfaces 90, 90*a*, 90*b* of the throttle levers 30, 30*a*, 30*b* of FIGS. 1-15. Also, as shown in FIGS. 19 and 20, the choke lever 162 includes a follower surface 236 engaged with the cam surface 194 on the second arm 190 of the intermediate lever 174.

With continued reference to FIGS. 19 and 20, the follower surface 186 on the intermediate lever 174 includes an arcuate segment 238 having a constant radius R centered on an axis 242 substantially parallel with the axis 154 of the throttle lever 146. In the illustrated construction, the axis 242 is coaxial with the axis 154 of the throttle lever 146, such that a vector of the reaction force applied to the cam surface 230 by the follower surface 186, at any point along the arcuate segment 238, passes through or intersects the axis 154 of the throttle lever 146 when the intermediate lever 174 is pivoted in a clockwise direction to the positions shown in FIGS. 19 and 20. Such a vector is also normal to a line tangent to both the cam surface 230 and the follower surface 186 at that point of the arcuate segment 238.

With reference to FIG. 19, a first end 246 of the arcuate segment 238 substantially coincides with a throttle valve angle A11 of about 58 degrees from the central axis 138. In other words, the cam surface 230 engages the follower surface 186 at a location coincident with the first end 246 of the arcuate segment 238 when the throttle valve 142 is moved to a throttle valve angle of about 58 degrees from the fully-opened position of the throttle valve 142 shown in FIG. 18. With reference to FIG. 20, a second end 250 of the arcuate segment 238 substantially coincides with a throttle valve angle A12 of about 75 degrees from the central axis 138. In other words, the cam surface 230 engages the follower surface 186 at a location coincident with the second end 250 of the arcuate segment 238 when the throttle valve 142 is moved to a throttle valve angle of about 75 degrees from the fully-opened position of the throttle valve 142 shown in FIG. 18. As such, the cam surface 230 engages the arcuate segment 238 over about 17 degrees of throttle valve opening, from the position of the throttle valve 142 shown in FIG. 19 to the position of the throttle valve 142 shown in FIG. 20. Alternatively, the arcuate segment 238 of the follower surface 186 may include a length less than that shown in FIGS. 19 and 20, such that the cam surface 230 engages the arcuate segment 238 less than about 17 degrees of throttle valve opening. Further, the arcuate segment 238 of the follower surface 186 may include a length greater than that shown in FIGS. 19 and 20, such that the cam surface 230 engages the arcuate segment 238 more than about 17 degrees of throttle valve opening.

In an alternative construction of the carburetor 126, the axis 242 of the constant radius R of the arcuate segment 238 may be slightly offset from the axis 154 of the throttle valve 142 when the intermediate lever 174 is pivoted in a clockwise direction between the positions shown in FIGS. 19 and 20. As a result, a vector of the reaction force applied to the cam surface 230 by the follower surface 186, at any point along the arcuate segment 238, does not intersect the axis 154 of the throttle lever 146, but instead is disposed in close proximity to the axis 154 of the throttle lever 146. Such a configuration may result in a small, but acceptable reaction torque applied to the throttle lever 146 (e.g., less than about 10 inch-grams) that does not significantly interfere with the operation of the governor.

In an engine incorporating the carburetor 126 of FIGS. 16-20, the throttle lever 146 is biased toward the position shown in FIG. 18 by the governor lever or a biasing member (e.g., a return spring) to orient the throttle valve 142 in a wide-open or fully-opened position in preparation for a cold-start of the engine. In addition, the choke lever 162 is biased toward the position shown in FIG. 18 by the spring 224 to orient the choke valve 158 in a closed position in preparation for a cold-start of the engine. Immediately after start-up of the engine, the governor actuates the governor lever to move the throttle lever 146 in a counter-clockwise direction, as shown in FIGS. 19 and 20, to move the throttle valve 142 to a particular position or throttle valve angle to achieve a no-load desired operating speed of the engine. In the illustrated configuration of the carburetor 126 in FIG. 20, the selected no-load operating speed of the engine is achieved by moving the throttle valve 142 to a position where it is about 75 degrees from the central axis 138. Alternatively, the carburetor 126 may be configured such that the selected no-load operating speed of the engine is achieved at a throttle valve angle corresponding with engagement of the cam surface 230 and follower surface 186 anywhere along the arcuate segment 238.

With reference to FIGS. 18-20, as the throttle lever 146 is pivoted from its position shown in FIG. 18 to its position shown in FIG. 20, the throttle lever 146 applies a force on the first arm 182 of the intermediate lever 174 which, in turn, applies a force to the choke lever 162 via the second arm 190 to open the choke valve 158. As previously discussed, the return spring 224 biases the choke lever 162 to a position in which the choke valve 158 is closed (see FIG. 18). As a result, the choke lever 162 applies a reaction force on the throttle lever 146, via the intermediate lever 174, along a vector normal to a line tangent to both the cam surface 230 and the follower surface 186. When the reaction force is misaligned with the axis 154 of the throttle lever 146, the reaction force imparts a reaction torque on the throttle lever 146. FIG. 19 illustrates a range of engagement 258 of the cam surface 230 and the follower surface 186 along which the reaction force is misaligned with the axis 154 of the throttle lever 146. The magnitude of the reaction torque is dependent upon the geometry of the throttle lever 146, the intermediate lever 174, and the choke lever 162, in addition the spring rate of the return spring 224.

With reference to FIGS. 19 and 20, however, the constant radius R of the arcuate segment 238 ensures that the vector of the reaction force applied to the cam surface 230 by the follower surface 186 is aligned or intersects the axis 154 of the throttle lever 146. As a result, the reaction force applied to the throttle lever 146 cannot impart a corresponding reaction torque on the throttle lever 146 to impede or otherwise affect the movement of the throttle lever 146 within the range of engagement of the cam surface 230 and follower surface 186 along the arcuate segment 238. By substantially eliminating the reaction torque on the throttle lever 146 within the range of engagement of the cam surface 230 and follower surface 186 along the arcuate segment 238, the carburetor 126 may be configured to provide a wide range of selectable no-load operating speeds of an engine within which interference with the governor's control of the throttle lever 146 is substantially minimized or prevented. In addition, the throttle lever 146 may move within the range of engagement of the cam surface 230 and follower surface 186 along the arcuate segment 238 in response to engine loading, without substantial concern of override or interference with the governor's control of the throttle lever 146 by the reaction force applied to the throttle lever 146 by the choke lever 162 via the intermediate lever 174.

After the engine has started, the thermally conductive assembly may be activated to further pivot the intermediate lever 174, and therefore the choke lever 162, to disengage the intermediate lever 174 from the throttle lever 146 and maintain the choke lever 162 in a position in which the choke valve 158 is fully opened. During a hot-restart of the engine, the thermally conductive assembly may remain activated to maintain the choke valve 158 in its fully-opened position.

FIGS. 21-25 illustrate a fifth construction of a carburetor 262 configured for use with a small engine. Like components are labeled with like reference numerals, plus the letter "a," and will not be described again in detail. The operation of the carburetor 262 is substantially similar to the carburetor 126 of FIGS. 16-20. However, the arcuate segment **238*a* has a length such that the cam surface 230*a* engages the arcuate segment 238*a* over about 30 degrees of throttle valve opening, from the position of the throttle valve 142*a* shown in FIG. 24, in which the throttle valve 142*a* has a throttle valve angle A13 of about 45 degrees from the central axis 138*a*, to the position of the throttle valve 142*a* shown in FIG. 25, in which the throttle valve 142*a* has a throttle valve angle A14 of about 75 degrees from the central axis 138*a***.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A carburetor configured for use with an internal combustion engine, the carburetor comprising:

a body defining a passageway therein;

a throttle lever including a cam surface;

a throttle valve positioned in the passageway and responsive to movement of the throttle lever, the throttle lever configured to rotate about a first axis from a wide-open first position to a second position at least 50 degrees from the first position;

a choke lever including a follower surface configured to being engaged by the cam surface; and a choke valve positioned in the passageway and responsive to movement of the choke lever;

wherein one of the cam surface and the follower surface includes an arcuate segment having a constant radius centered on a second axis, wherein the second axis is axially aligned with the first axis, and wherein the arcuate segment is sufficiently long such that the throttle valve is configured to move at least 15 degrees while the other of the cam surface and the follower surface engages the arcuate segment.

2. The carburetor of claim 1, wherein the engaged cam surface and follower surface, along the arcuate segment, define a plurality of radial lines of contact that intersect the first axis.

3. The carburetor of claim 1, wherein the arcuate segment includes a first end and a second end, and wherein said one of the cam surface and the follower surface engages the first end of the arcuate segment when the throttle valve is rotated at least 40 degrees from the wide-open first position.

4. The carburetor of claim 3, wherein said one of the cam surface and the follower surface engages the second end of the arcuate segment when the throttle valve is rotated to the second position.

5. The carburetor of claim 1, wherein the cam follower surface is resiliently biased to a position out of contact with the cam surface.

6. The carburetor of claim 1, wherein the cam surface is resiliently biased to the wide open first position.

7. The carburetor of claim 1, wherein the cam surface includes the arcuate segment.

8. The carburetor of claim 1, wherein the follower surface includes the arcuate segment.

9. The carburetor of claim 1, wherein the throttle lever is biased to orient the throttle valve in a wide-open position in preparation for a cold start of the engine.

10. The carburetor of claim 1, wherein the choke lever is biased to orient the choke valve in a closed position in preparation for a cold start of the engine.

11. The carburetor of claim 1 further comprising a spring biasing the choke lever to orient the choke valve in the closed position in preparation for the cold start of the engine.

12. The carburetor of claim 1 further comprising an aperture in the throttle lever for receiving a governor shaft, the aperture located eccentric with respect to the first axis.

13. The carburetor of claim 1 further comprising a governor shaft operably coupled to the throttle lever eccentric to the first axis.

14. A method comprising:

moving a throttle lever so as to rotate a throttle valve position in a passageway of a carburetor about a first axis from a wide-open first position to a second position at least 50 degrees from the first position;

engaging a follower surface of a choke lever with a cam surface of the throttle lever to move a choke valve positioned in the passageway, wherein reaction forces between the follower surface and the cam surface intersect the first axis during movement of the throttle valve at least 15 degrees while the cam surface and the follower surface are in engagement.

15. The method of claim 14, wherein one of the cam surface and the follower surface has a constant radius centered on a second axis for at least 15 degrees about the second axis.

16. The method of claim 15, wherein the second axis is axially aligned with the first axis.

17. The method of claim 15, wherein the cam surface and the follower surface, when engaged along an arcuate segment, comprise a plurality of radial lines of contact that intersect the first axis.

18. The method of claim 17, wherein the arcuate segment includes a first end and a second end, wherein said one of the cam surface and the follower surface engages the first end of the arcuate segment when the throttle valve is rotated at least 40 degrees from the wide-open first position.

19. The method of claim 17, wherein the cam surface includes the arcuate segment.

20. The method of claim 17, wherein the follower surface includes the arcuate segment.

21. The method of claim 14 further comprising resiliently biasing the follower surface to a position out of contact with the cam surface.

22. The method of claim 14 further comprising resiliently biasing the cam surface to the wide-open first position.

23. A carburetor configured for use with an internal combustion engine, the carburetor comprising:

a body defining a passageway therein;

a throttle lever including a cam surface;

a throttle valve positioned in the passageway and responsive to movement of the throttle lever, the throttle lever configured to rotate about a first axis from a wide-open first position to a second position at least 50 degrees from the first position;

a choke lever including a follower surface configured to being engaged by the cam surface; and a choke valve positioned in the passageway and responsive to movement of the choke lever;

wherein the cam surface and the follower surface are configured such that reaction forces between the follower surface and the cam surface intersect the first axis during movement of the throttle valve at least 15 degrees while the cam surface and the follower surface are in engagement.

24. The carburetor of claim 23, wherein one of the cam surface and the follower surface has a constant radius centered on a second axis for at least 15 degrees about the second axis.

* * * * *